US011059254B2

(12) United States Patent
Ponti

(10) Patent No.: US 11,059,254 B2
(45) Date of Patent: Jul. 13, 2021

(54) FOLDING STATION OF A CARDBOARD BLANK FOR PACKING AN ARTICLE RESTED ON THE CARDBOARD BLANK AND A MACHINE FOR PACKAGING AN ARTICLE INTERNALLY OF A CARDBOARD BOX OBTAINED FROM THE CARDBOARD BLANK

(71) Applicant: F.L. AUTO S.R.L., Rome (IT)

(72) Inventor: Giuseppe Ponti, Cerbara-Citta' di Castello (IT)

(73) Assignee: F.L. AUTO S.R.L., Rome (IT)

( * ) Notice: Subject to any disclaimer, the term of this patent is extended or adjusted under 35 U.S.C. 154(b) by 325 days.

(21) Appl. No.: 16/303,394

(22) PCT Filed: May 18, 2017

(86) PCT No.: PCT/IB2017/052938
§ 371 (c)(1),
(2) Date: Nov. 20, 2018

(87) PCT Pub. No.: WO2017/203399
PCT Pub. Date: Nov. 30, 2017

(65) Prior Publication Data

US 2020/0039168 A1 Feb. 6, 2020

(30) Foreign Application Priority Data

May 24, 2016 (IT) ..... 102016000053173

(51) Int. Cl.
*B31B 50/36* (2017.01)
*B31B 50/54* (2017.01)
(Continued)

(52) U.S. Cl.
CPC ..... *B31B 50/36* (2017.08); *B31B 50/54* (2017.08); *B31B 50/81* (2017.08);
(Continued)

(58) Field of Classification Search
CPC . B31B 50/36; B31B 50/54; B31B 2100/0026; B31B 2110/35; B31B 50/81;
(Continued)

(56) References Cited

U.S. PATENT DOCUMENTS 4,300,679 A * 11/1981 Benzschawel ..... B65D 5/0245 206/424
4,571,916 A * 2/1986 Meuwly ..... B65B 35/40 198/419.3
(Continued)

FOREIGN PATENT DOCUMENTS

DE 28 19 000 A1 11/1978
WO WO 2014/033635 A1 3/2014

*Primary Examiner* — Thanh K Truong
*Assistant Examiner* — Katie L Gerth
(74) *Attorney, Agent, or Firm* — R. Neil Sudol; Henry D. Coleman

(57) ABSTRACT

A conveyor of a cardboard-folding station receives a cardboard blank having a first portion, first and second lateral closing walls hinged thereto and facing upstream and downstream, respectively, an upper closing wall hinged to the second lateral closing wall and facing downstream, a third and a fourth lateral closing wall hinged and partly raised with respect to the first portion and projecting from sides of the conveyor. An article rests on the first portion, with four flanks or the article respectively facing the four lateral closing walls of the blank. At a first folding zone the third and fourth lateral closing walls are folded to cover the third and the fourth flanks of the article, and at a second folding zone the second lateral closing wall and the upper closing wall are folded to cover the article's second flank and its upper face.

18 Claims, 19 Drawing Sheets

(51) Int. Cl.

| | |
|---|---|
| ***B31B 100/00*** | (2017.01) |
| ***B31B 110/35*** | (2017.01) |
| ***B31B 50/81*** | (2017.01) |
| ***B65B 5/02*** | (2006.01) |
| *B65D 5/28* | (2006.01) |
| *B65D 5/44* | (2006.01) |

(52) U.S. Cl.
CPC ... *B31B 2100/0026* (2017.08); *B31B 2110/35* (2017.08); *B65B 5/024* (2013.01); *B65D 5/28* (2013.01); *B65D 5/443* (2013.01)

(58) Field of Classification Search
CPC ..... B31B 2100/00; B31B 2120/102; B31B 2120/502; B31B 2120/004; B31B 50/00; B65B 5/024; B65B 2210/04; B65D 5/28; B65D 5/443; B65D 5/20; B65D 5/2095
See application file for complete search history.

(56) References Cited

U.S. PATENT DOCUMENTS

| | | | | |
|---|---|---|---|---|
| 4,727,708 | A * | 3/1988 | Conforto | B65B 5/024 53/534 |
| 6,478,725 | B1 * | 11/2002 | Bengt | B26D 1/245 493/59 |
| 6,904,733 | B2 * | 6/2005 | Boix Jaen | B65B 5/024 53/209 |
| 9,394,113 | B2 * | 7/2016 | Werner | B65G 41/003 |
| 10,543,945 | B2 * | 1/2020 | Sytema | B65B 5/024 |
| 10,836,517 | B2 * | 11/2020 | Ponti | B65D 5/10 |
| 2006/0100079 | A1 * | 5/2006 | Graham | B31B 50/00 493/71 |
| 2010/0263333 | A1 * | 10/2010 | Langen | B65D 5/42 53/456 |
| 2012/0100976 | A1 * | 4/2012 | Graham | B31B 50/00 493/52 |
| 2015/0224731 | A1 * | 8/2015 | Ponti | B65B 57/12 493/59 |
| 2015/0225110 | A1 * | 8/2015 | Ponti | B65D 5/20 53/456 |
| 2015/0360433 | A1 * | 12/2015 | Feijen | B31B 50/74 53/456 |
| 2019/0300210 | A1 * | 10/2019 | Ponti | B65B 43/10 |
| 2020/0031083 | A1 * | 1/2020 | Ponti | B31B 50/20 |
| 2020/0031084 | A1 * | 1/2020 | Ponti | B65B 5/024 |
| 2020/0039168 | A1 * | 2/2020 | Ponti | B31B 50/54 |

* cited by examiner

FOLDING STATION OF A CARDBOARD BLANK FOR PACKING AN ARTICLE RESTED ON THE CARDBOARD BLANK AND A MACHINE FOR PACKAGING AN ARTICLE INTERNALLY OF A CARDBOARD BOX OBTAINED FROM THE CARDBOARD BLANK

DESCRIPTION OF THE INVENTION

The present invention relates to the particular technical sector concerning packaging and packing of articles internally of a cardboard box.

In particular the present invention relates to a folding station for folding a cardboard blank about an article and a machine for realising a packing of an article internally of a cardboard box obtained from the cardboard blank

DESCRIPTION OF THE PRIOR ART

In the sector of logistics and goods dispatching, the need to pack and package the goods to be dispatched is known, in relative cardboard boxes, with the purpose of protecting and safeguarding them.

The Applicant has realised a special cardboard blank for packaging articles, usable for forming a cardboard box with reinforced walls for packing and packaging an article internally thereof, so as to give a special protection and resistance against impact, and the Applicant also set up special operating procedures for obtaining and realising, from a cardboard sheet, on the basis of the effective dimensions of the article to be packed, the relative cardboard blank and enveloping it about the article so as to package it internally of a box. The Applicant is the owner of Italian patent application no. 102015000014902 of Mar. 13, 2015 in which the special shape of a cardboard blank for packaging utilisable for the packaging of articles is described.

The cardboard blank (C) of the present patent application is illustrated in FIG. 1 and has the peculiarity of comprising parts that are foldable onto other parts so as to identify reinforced walls utilisable for enveloping the article to be packed.

In particular, the cardboard blank (C) has a quadrilateral shape, which can be for example square or preferably rectangular, with two transversal edges (B1, B2) and two longitudinal edges (BL), and comprises, at a first transversal edge (B1) and a second transversal edge (B2), two longitudinal score lines (L1, L2), parallel to one another: the two longitudinal score lines (L1, L2) identify, in the cardboard sheet, a central sector (SC) and two lateral sectors (SL1, SL2). Usually, the articles to be packed and dispatched have, or are predisposed in, containers having a parallelepiped shape, with a quadrangular or rectangular base.

The two longitudinal score lines (L1, L2) are realised on the cardboard blank (C) distanced from one another on the basis of the effective dimensions of the base of the article to be packed, for example on the basis of the length (L) of the base of the article.

The cardboard blank (C) further comprises four transversal score lines (T1, T2, T3, T4), parallel to one another and such as to identify, on the central sector (SC) of the cardboard blank (C) and between the two transversal edges (B1, B2), five portions (P1, P2, P3, P4, P5).

The four transversal score lines (T1, T2, T3, T4)) are made so as to be distanced from one another as a function of the effective dimensions of the article to be packed, in particular on the basis of the width (I) of the base of the article, the width (L*) of the upper face and the height (H) of the flanks of the article.

In detail, starting from a first transversal edge (B1) of the cardboard blank (C);

- the first transversal score line (T1) and the second transversal score line (T2) are realised so as to be distant from one another by a distance (I) corresponding to the width of the base of the article to be packed, in this way, in the central sector (SC) of the cardboard blank (C) a first portion (P1) is identified that has dimensions corresponding to the base of the article to be packed, and on which first portion (P1) the article can be rested during the packaging operations;
- the first transversal score line (T1) is realised at a distance from the first transversal edge (B1) of the cardboard blank (C) such that it corresponds to the height (H) of a first lateral flank of the article, and in this way, in the central sector (SC) of the cardboard box (C) a second portion (P2) is identified between the first transversal edge (B1) and the first portion (P1), of dimensions corresponding to a first lateral flank of the article to be packed, and destined to cover the first flank of the article during the packaging operations once folded about the first transversal score line (T1);
- the third transversal score line (T3) is realised so as to be distant from the second transversal score line (T2) by a distance corresponding to the height (H) of a second flank of the article, parallel and opposite the first flank; in this way, in the central sector (SC) of the cardboard blank (C) a third portion (P3) is defined, adjacent to the first portion (P1) and on the opposite side to the second portion (P2), having dimensions corresponding to the second lateral flank of the article to be packed, and destined to cover the second flank during the packaging operations once folded about the second transversal score line (T2);
- the fourth transversal score line (T4) is realised so as to be distant from the third transversal score line (T3) by a distance corresponding to the width (L*) of the upper face of the article to be packed, in this way, in the central sector (SC) of the cardboard blank (C), a fourth portion (P4) is defined, adjacent to the third portion (P3), having dimensions corresponding to the upper face of the article to be packed, and destined to cover the upper flank once the third portion (P3) has been folded about the second transversal score line (T2) in order to cover the second flank of the article, and the fourth portion (P4) has been folded about the third transversal score line (T3).

The cardboard blank (C) further comprises, again in the central sector (SC), a fifth portion (P5), adjacent to the fourth portion (P4) and hinged thereto by means of the fourth transversal score line (T4), which constitutes a closing/opening tab (AC) that is destined to be glued to the second portion (P2) of the cardboard blank (C), once the second portion (P2) has been folded to envelop the first flank of the article and the third portion (P3) and the fourth portion (P4) have been folded respectively to envelop the second flank of the article and the upper face of the article.

The cardboard blank (C) further comprises, for each of the two lateral sectors (SL1, SL2), four transversal cuts (l1, l2, l3, l4) which extend from the longitudinal edges (BL) of the cardboard blank (C) up to arriving at the two longitudinal score lines (L1, L2), and which are made at the four transversal score lines (T1, T2, T3, T4).

In this way, in the two lateral sectors (SL1, SL2) of the cardboard blank, the cardboard blank (C) comprises:

between the first transversal edge (B1) of the cardboard blank (C) and the transversal cuts (I1) made at the first transversal score line (T1): a first reinforcing flap (R1), at a first end of the second portion (P2), and a second reinforcing flap (R2) at a second end of the second portion (P2);

between the transversal cuts (I2) realised at the second transversal score line (T2) and the third transversal cuts (I3) realised at the third transversal score line (T3): a third reinforcing flap (R3) at a first end of the third portion (P3), and a fourth reinforcing flap (R4) at a second end of the third portion (P3);

between the first transversal cuts (I1) realised at the first transversal score line (T1) and the transversal cuts (I2) realised at the second transversal score line (T2), a first lateral enveloping flap (A1) at a first end of the first portion (P1), and a second lateral enveloping flap (A2), at a second end of the first portion (P1);

between the transversal cuts (I3) made at the third transversal score line (T3) and the transversal cuts (I4) made at the fourth transversal score line (T4), a fifth reinforcing flap (R5) hinged to a first end of the fourth portion (P4), and a sixth reinforcing flap (R6) at a second end of the fourth portion (P4).

With this particular conformation, the cardboard blank (C), before the operations of packaging an article internally thereof, enables the forming of reinforced walls for enveloping corresponding walls/flanks of the article.

In fact, the first reinforcing flap (R1) is foldable on the second portion (P2) about the first longitudinal score line (L1), while the second reinforcing flap (R2) is in turn foldable on the second portion (P2) about the second longitudinal score line (L2) so as to at least partly superpose on the first reinforcing flap (R1): in this way the second portion (P2) of the central sector (SC) of the cardboard blank, with the first reinforcing flap (R1) and second reinforcing flap (R2) folded thereon and at least partly superposed, constitutes a first lateral closing wall (C1) which is foldable about the first transversal score line (T1) for covering the first lateral flank of the article to be packed (see for example FIGS. 1A, 1B).

The third reinforcing flap (R3) is foldable on the third portion (P3) about the first longitudinal score line (L1), while in turn the fourth reinforcing flap (R4) is foldable on the third portion (P3) about the second longitudinal score line (L2) so as to at least partly suppose on the third reinforcing flap (R3): in this way the third portion (P3) of the central sector (SC) of the cardboard blank (C), with the third reinforcing flap (R3) and fourth reinforcing flap (R4) folded thereon and at least partly superposed, constitutes a second lateral closing wall (C2) which is foldable about the second transversal score line (T2) for covering the second lateral flank, opposite the first flank, of the article to be packed (see for example FIGS. 1A, 1B, 1C).

The fifth reinforcing flap (R5) is foldable on the fourth portion (P4) bout the first longitudinal score line (L1), while the sixth reinforcing flap (R6) is in turn foldable on the fourth portion (P4) about the second longitudinal score line (L2) so as to at least partly superpose on the fifth reinforcing flap (R5): in this way the fourth portion (P4) of the central sector (SC), with the fifth reinforcing flap (R5) and sixth reinforcing flap (R6) folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F).

The first lateral enveloping flap (A1) is foldable about the first longitudinal score line (L1) for maintaining a raised position with respect to the first portion (P1) on which the base of the article to be packed will be placed, in such a way as to be usable for covering and enveloping a third lateral flank of the article to be packed, while the second lateral enveloping flap (A2) is foldable about the second longitudinal score line (L2) for maintaining a raised position with respect to the first portion (P1), in such a way as to be usable for covering and enveloping the fourth flank, opposite the third, of the article to be packed (see for example FIGS. 1A, 1B).

FIGS. from 1A to 1E show the shape of the box that can be formed starting from the cardboard blank once the reinforcing flaps have been folded above the relative portions present on the central sector of the cardboard blank; the box will be conformed-to-measure on the basis of the effective dimensions of the base, the lateral flanks, the upper wall of the article to be packed.

In particular, the first lateral enveloping flap (A1) comprises a pair of longitudinal folding lines (a, b) parallel and realised at a distance such that on the first flap (A1), between the two folding lines (a, b), a third lateral closing wall (C3) is identified, having a height corresponding to the height of a third lateral flank of the article to be packed, and also a first folding tab (a1), between the third lateral closing wall (C3) and the first longitudinal score line (L1), and a second folding tab (a2), between the third lateral closing wall (C3) and the longitudinal edge (BL) of the cardboard blank (C) are identified.

The first folding tab (a1) is superposed on a part of the first portion (P1) once it has been rotated with respect to the first longitudinal score line (L1), so as to form a reinforcing edge, while the second folding tab (a2) is destined, once the third lateral closing wall (C3) has been folded with respect to the first folding tab (a1) for covering the third flank of the article, to be folded with respect to the third lateral closing wall (C3) for covering a portion of the upper face of the article, before the face is covered by the upper closing wall (PS).

Correspondingly, the second lateral enveloping flap (A2) comprises a pair of longitudinal folding lines (c, d) parallel and realised at a distance such that on the second flap (A2) a fourth lateral closing wall (C4) is identified, having a height corresponding to the height of a fourth lateral flank of the article to be packed, opposite the third flank, and also a third folding tab (a3), between the fourth lateral closing wall (C4) and the second longitudinal score line (L2), and a fourth folding tab (a4), between the fourth lateral closing wall (C4) and the second longitudinal edge (BL) of the cardboard blank (C) are identified.

The third folding tab (a3) is superposed on a part of the first portion (P1) once it has been rotated with respect to the second longitudinal score line (L2), so as to form a reinforcing edge, while the fourth folding tab (a4) is destined, once the fourth lateral closing wall (C4) has been folded with respect to the third folding tab (a3) for covering the fourth flank of the article, to be folded with respect to the fourth lateral closing wall (C4) for covering a portion of the upper face of the article, before the face is covered by the upper closing wall (PS) (see FIGS. 1C-1F).

SUMMARY OF THE INVENTION

The present invention has the aim of providing a folding station for folding the cardboard blank of FIG. 1A, i.e. a cardboard blank predisposed with the reinforced walls, about an article which is arranged resting on the first portion of the central sector of the cardboard blank, so as to envelop and cover three lateral flanks and the upper face of the article, in a rapid and effective way.

In particular, the present invention has the aim of providing a folding station able to rapidly and efficiently carry out the rotation and folding of the third and fourth lateral closing wall, the rotation and folding of the second and fourth folding tab, the rotation and folding of the second lateral closing wall, and the rotation and folding of the upper closing wall so as to partly envelop the article to be packed.

More precisely, the present invention has the aim of providing a folding station which receives in inlet a cardboard blank (C) such as the one described in the foregoing and illustrated in FIG. 1A, with an article (D) to be packed being arranged resting with the base thereof on the first portion (P1) of the central sector (SC) of the cardboard blank (C) and with a first lateral flank facing upstream towards the first lateral closing wall (C1), a second lateral flank, opposite the first flank, facing towards the second lateral closing wall (C2), a third lateral flank, transversal to the first two, facing towards the third lateral closing wall (C3), and a fourth lateral flank, opposite the third flank, facing towards the fourth lateral closing wall (C4), and realising:

- the rotation of the third lateral closing wall (C3) so as to position it facing and covering the third lateral flank of the article and the rotation of the second folding tab (a2) hinged to the third lateral closing wall (C3) so as to arrange the third lateral closing wall above a part of the upper face of the article;
- the rotation of the fourth lateral closing wall (C4) so as to position it facing and covering the fourth lateral flank of the article and the rotation of the fourth folding tab (a4) hinged to the fourth lateral closing wall (C4) so as to arrange the fourth lateral closing wall above a part of the upper face of the article;
- the rotation of the second lateral closing wall (C2) so as to position it facing and covering the second lateral flank of the article;
- and the rotation of the upper closing wall (PS) so as to arrange it above and covering the upper face of the article.

The present invention also has the aim of providing a machine for obtaining the cardboard blank described in the foregoing and illustrated in FIG. 1, starting from a continuous strip of cardboard stored in a fanfold, and having dimensions corresponding to the effective dimensions of the base, the lateral flanks and the upper wall of the article to be packed, and for carrying out all the operations necessary for carrying out the packaging of an article internally of a box obtained from the cardboard blank.

The objective of the invention is also to provide a machine able to carry out all the operations necessary for completing the packaging of an article internally of a cardboard box, very rapidly and efficiently, with the aim of guaranteeing high productivity in terms of numbers of articles packaged per hour, up to even 1000 articles packaged per hour.

BRIEF DESCRIPTION OF THE DRAWINGS

The characteristics of a preferred embodiment of a folding station for folding a cardboard blank about an article arranged resting on the cardboard blank, and a machine for packaging an article internally of a cardboard box obtained from the cardboard blank, of the present invention, will be described in the following with reference to the appended tables of drawings, in which.

Figure 1:
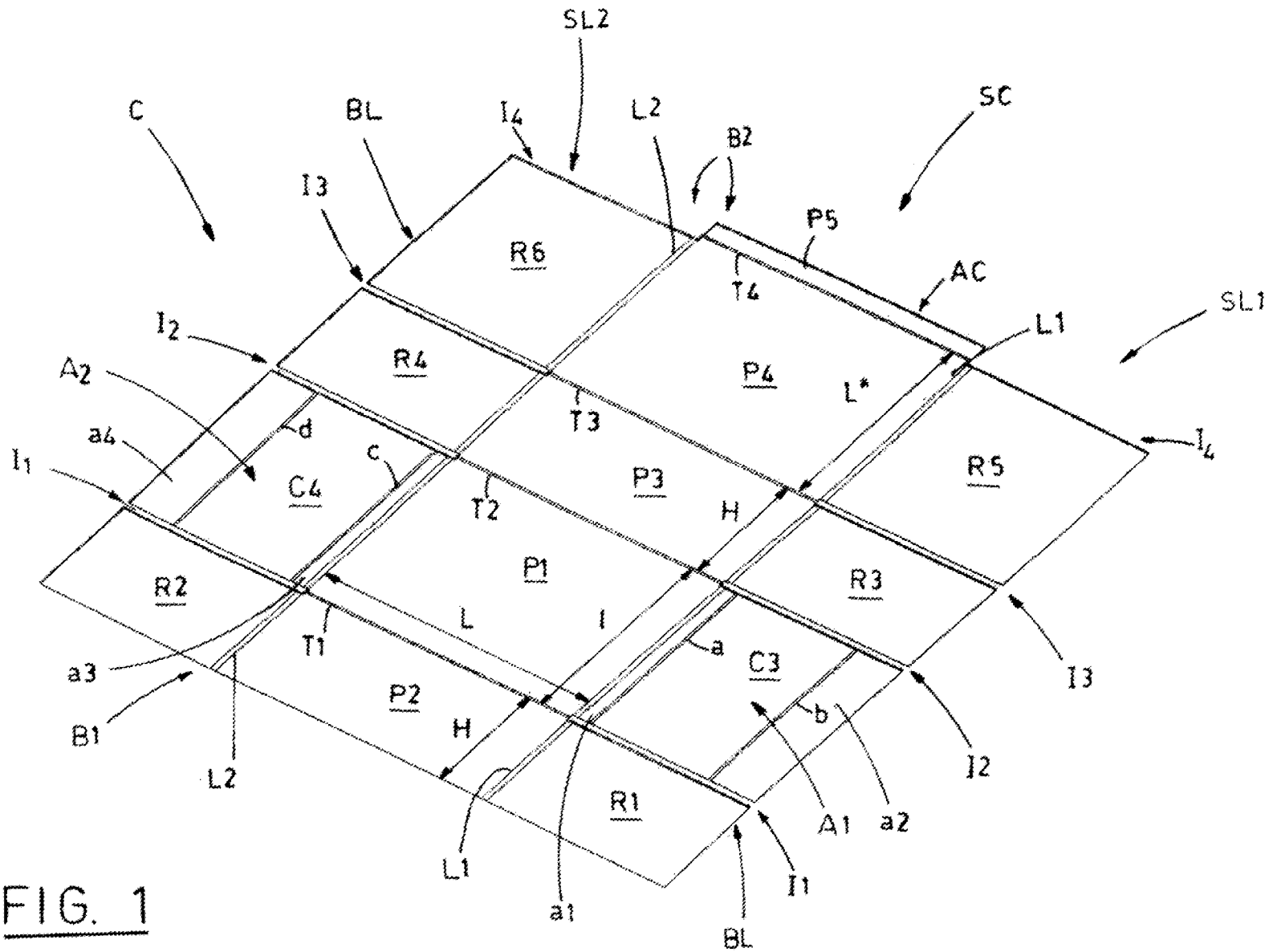
FIG. 1, mentioned in the preamble to the present description, in a perspective view illustrates the cardboard blank invented by the Applicant and object of the above-mentioned patent application, which is obtained and processed by the machine of the invention, so as to package an article inside a cardboard box obtained from the cardboard blank.
Figure 2A:
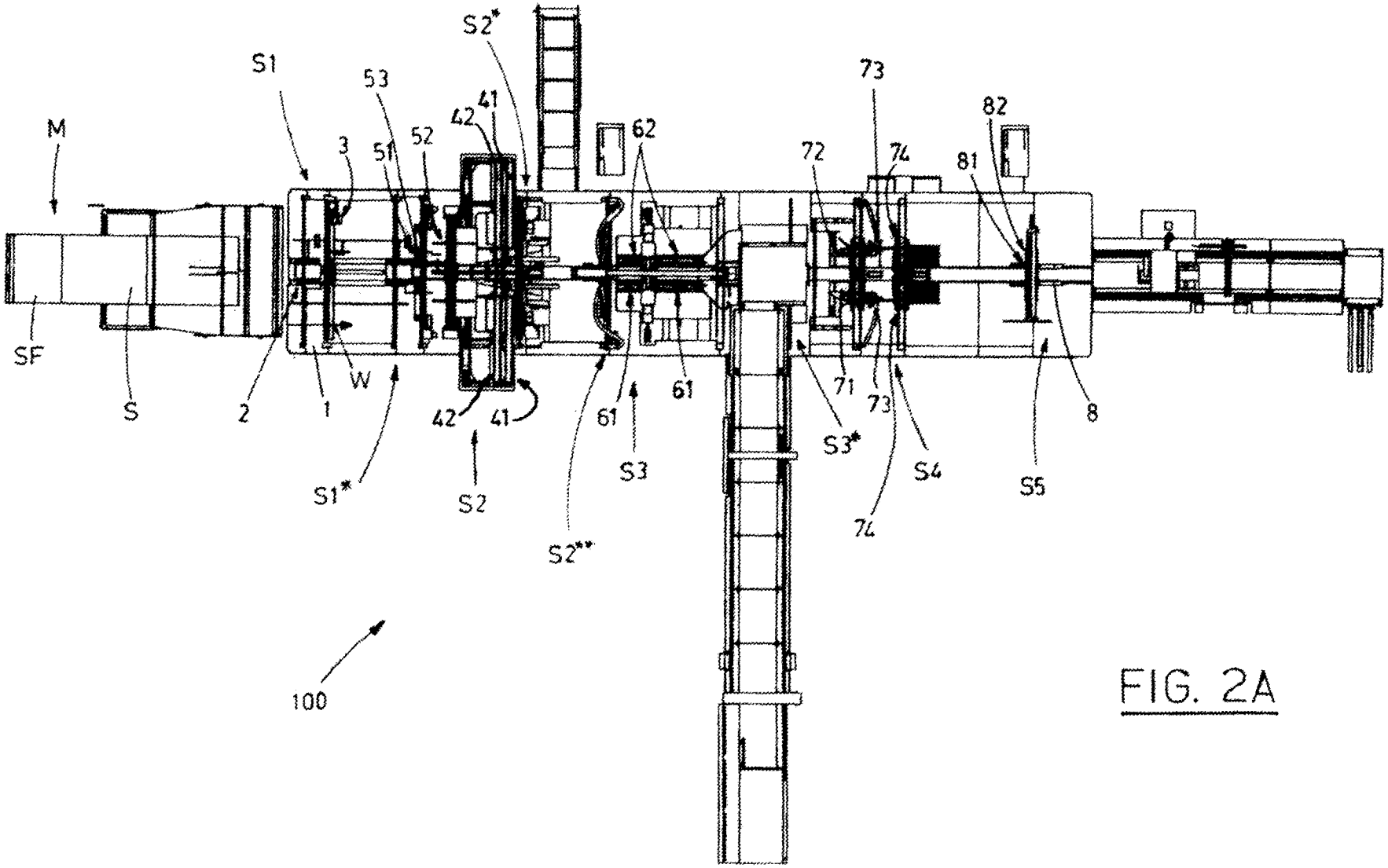
Figure 2B:
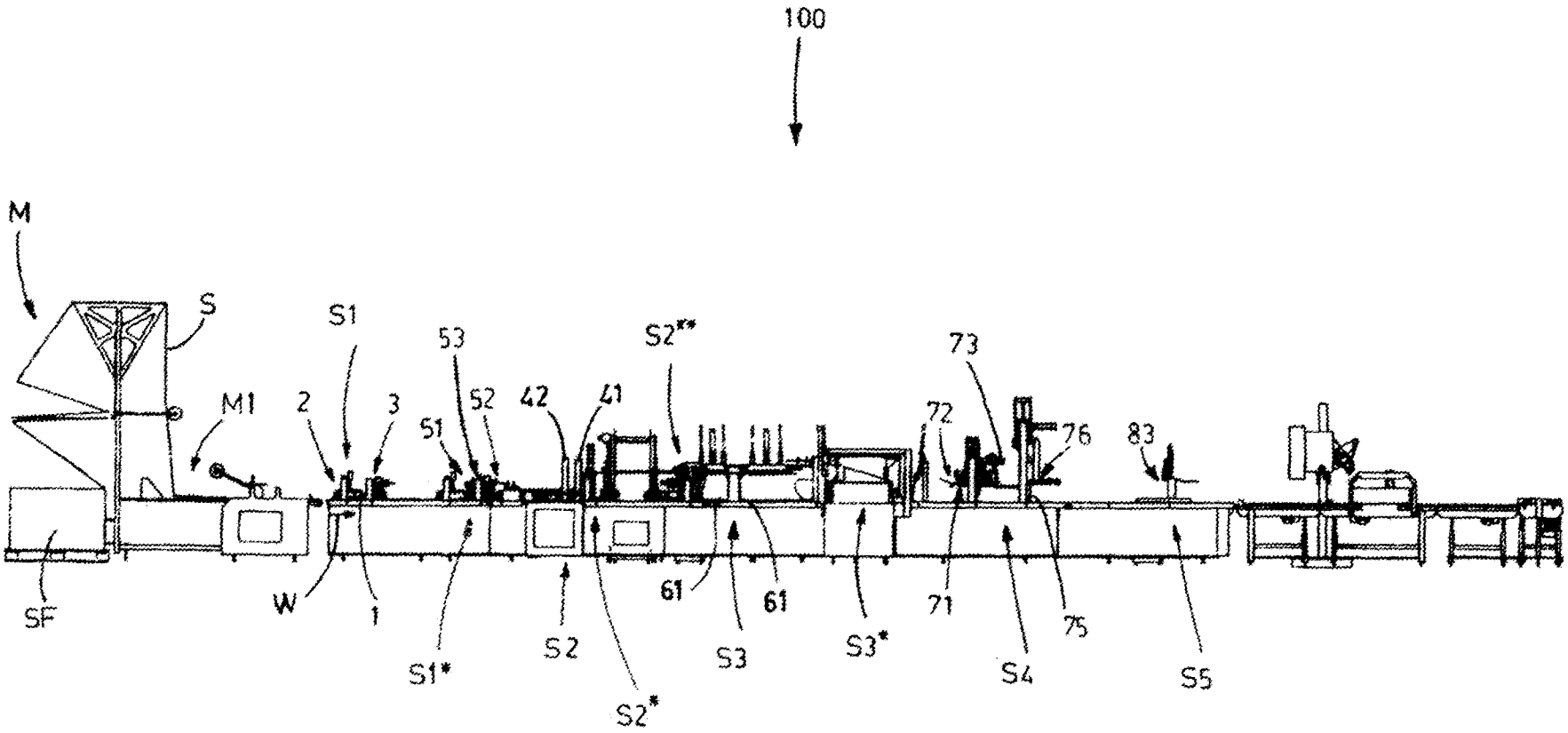
Figure 2C:
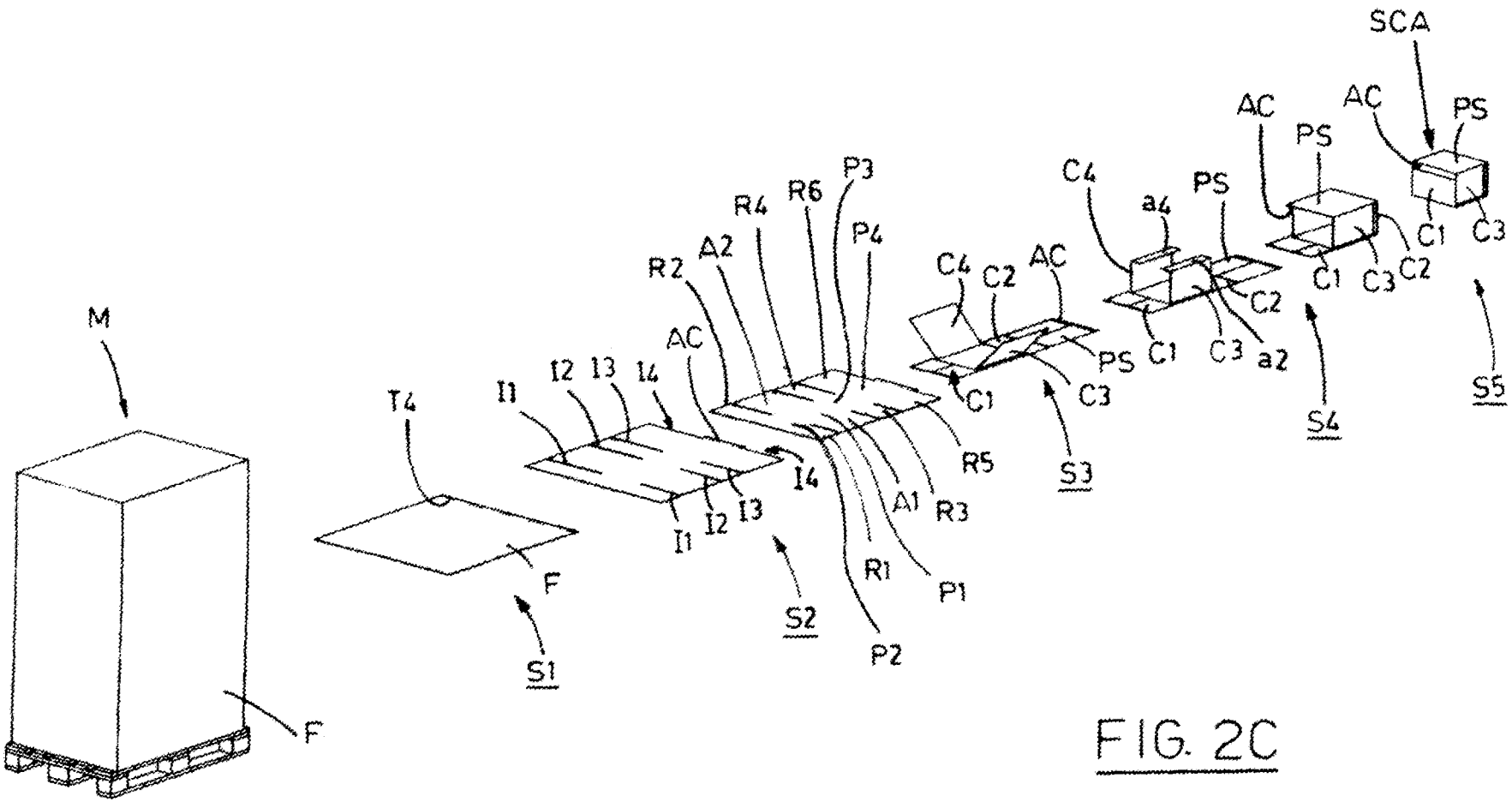
Figure 2D:
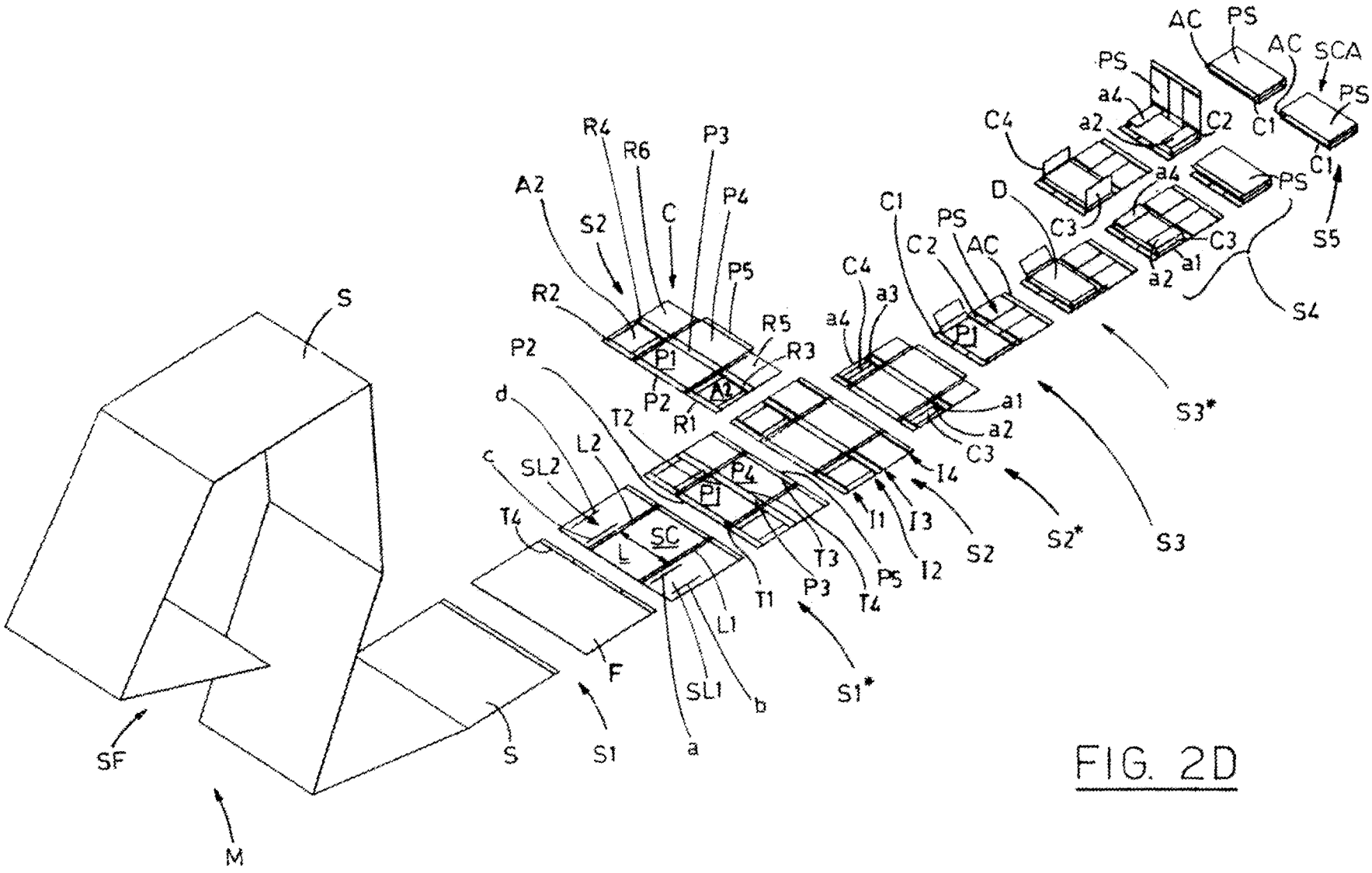
Figure 4A:
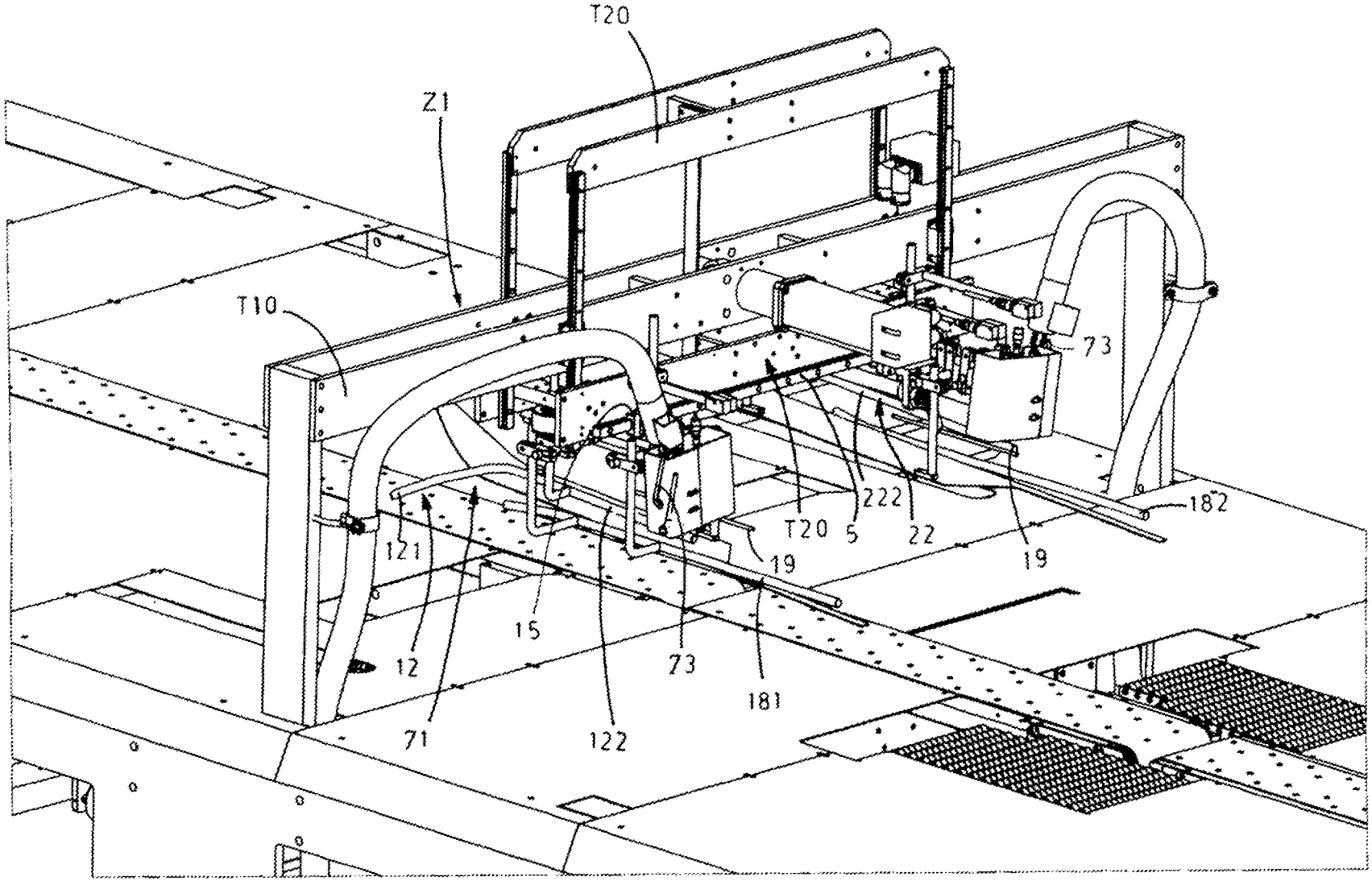
Figure 4B:
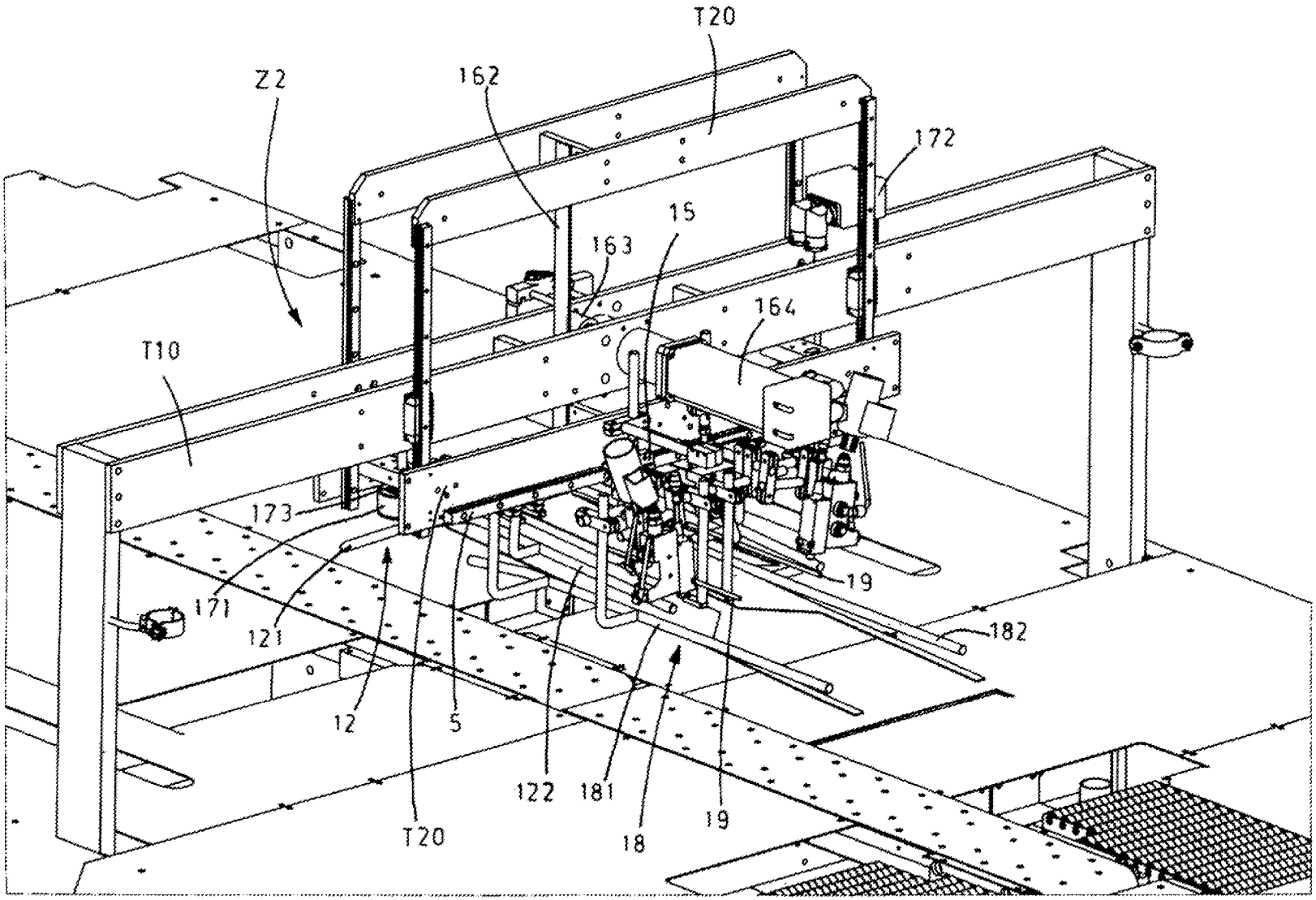
Figure 4C:
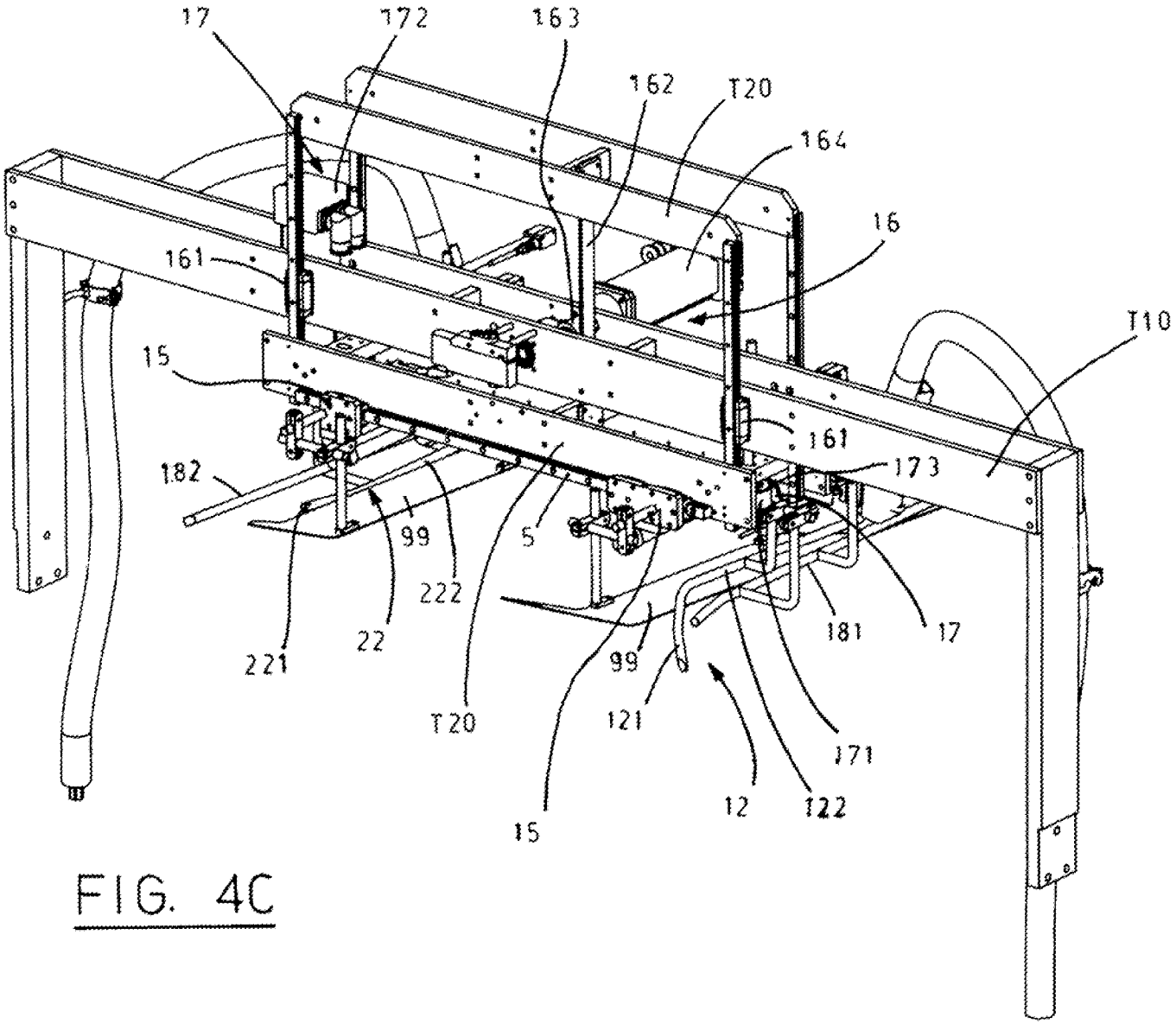
Figure 4D:
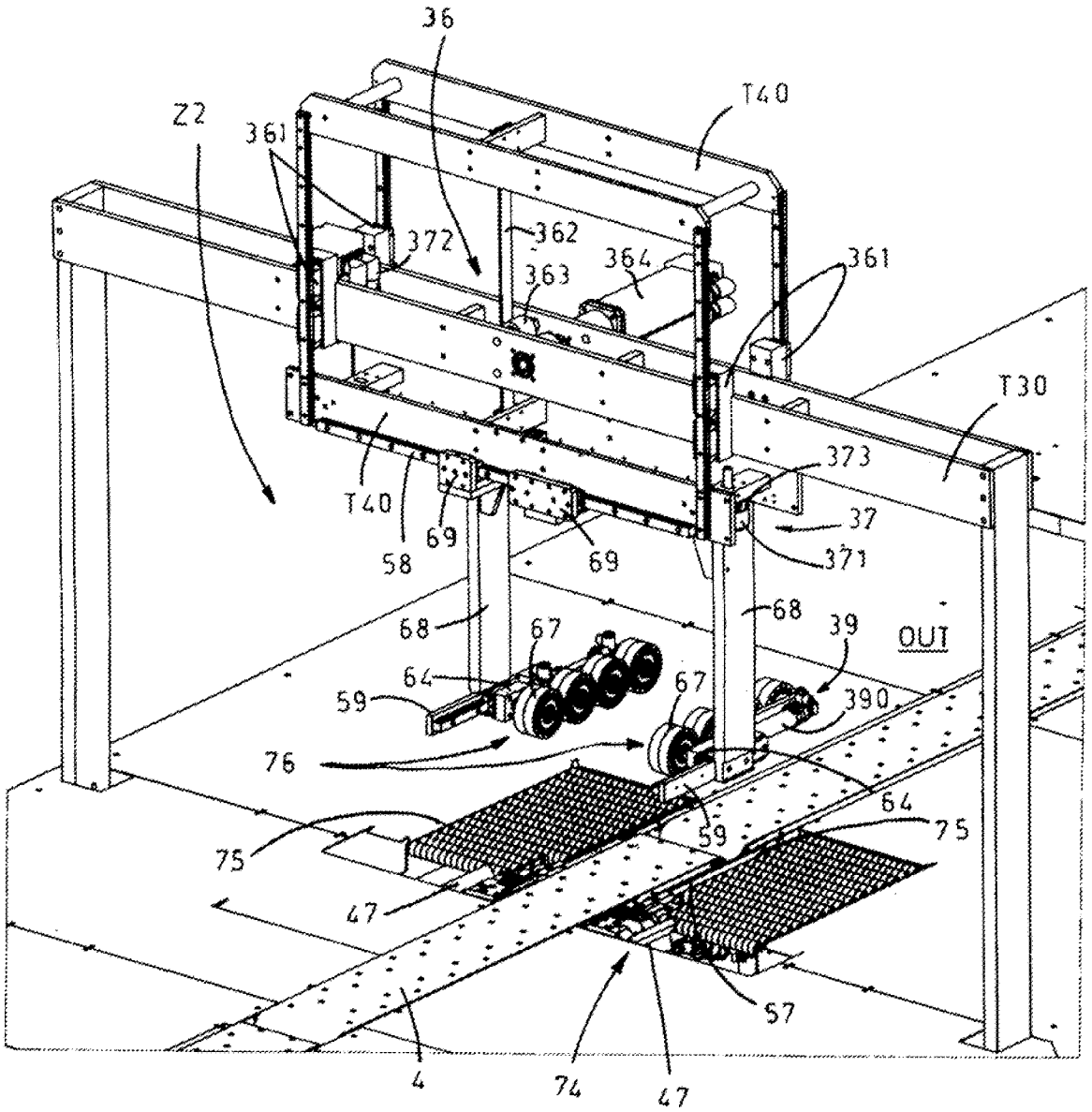
Figure 4E:
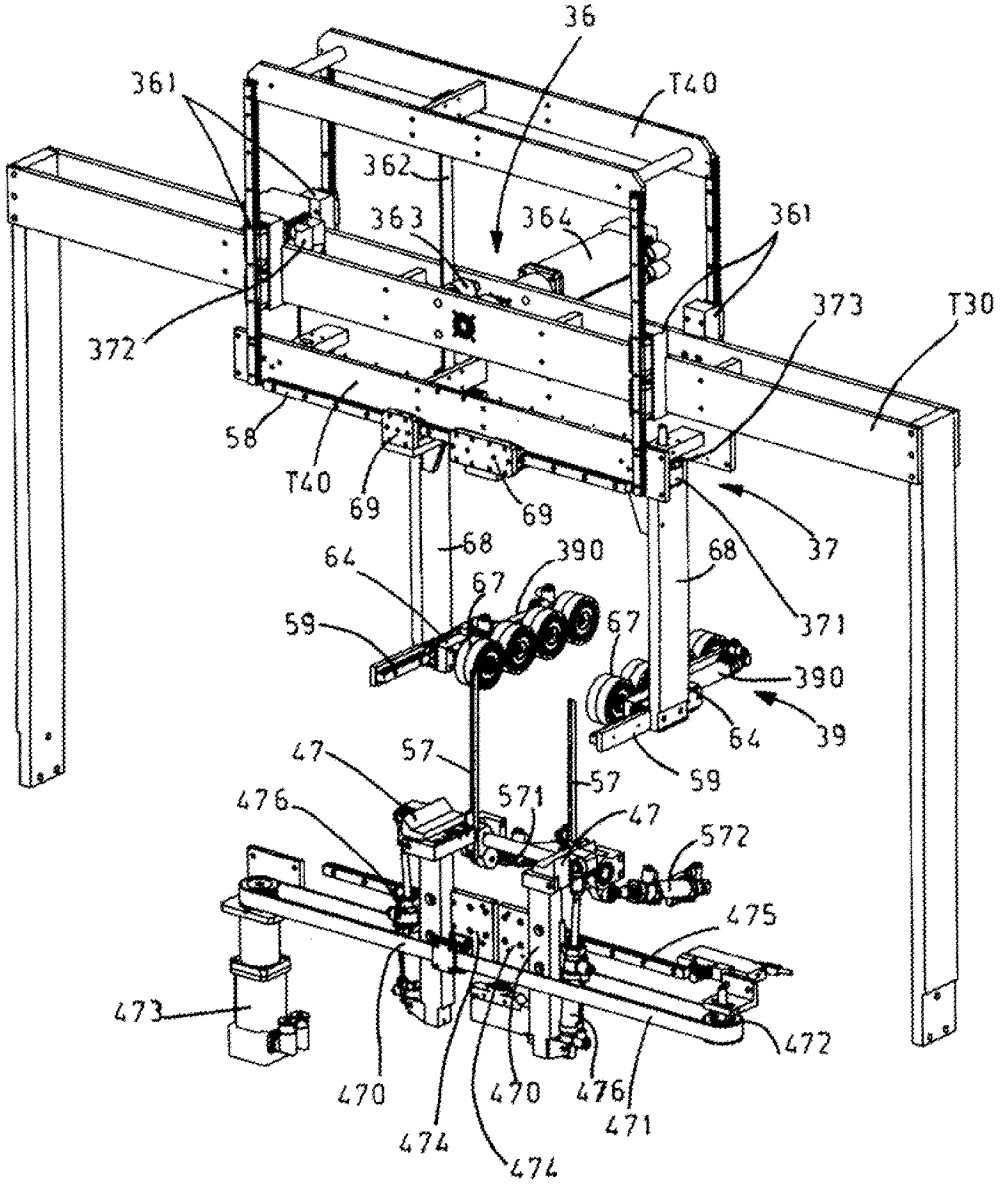

FIGS. from 1B to 1F illustrate, according to respective perspective views, possible folding steps of the cardboard blank of FIG. 1, described in the above-mentioned patent application filed by the Applicant, so as to enable packaging an article and obtaining a cardboard box for packing with an article closed inside it;

FIG. 2A illustrates, in a schematic view from above, the overall layout of a machine for packing an article internally of a cardboard box obtained from a cardboard sheet of the present invention;

FIG. 2B illustrates the machine of FIG. 2A in a lateral view;

FIG. 2C schematically illustrates, in a succession of images, example embodiments of some main work operations that the packaging machine of the invention carries out starting from a cardboard sheet cut from a continuous strip of cardboard contained in a fanfold, for obtaining first the cardboard blank illustrated in FIG. 1, and then folding the cardboard blank about an article and obtaining a closed cardboard box with the article packaged and closed inside it;

FIG. 2D very schematically illustrates, with a succession of images in perspective view, the operating sequence of the machine of the present invention;

FIGS. from 3A to 3H illustrates, in a schematic perspective view, the folding station of the present invention in successive operating steps of folding the cardboard blank about an article for the forming of a box with the article partly packaged internally thereof;

FIG. 4A illustrates, in a schematic perspective view, some significant components of the folding station of the present invention in a possible configuration thereof;

FIG. 4B illustrates, in a schematic perspective view, the components of FIG. 4A in a possible operating configuration thereof;

FIG. 4C illustrates, in a schematic perspective view from a different angle, the components of FIG. 4A with some parts of the folding station having been removed for greater clarity;

FIG. 4D illustrates, in a schematic perspective view, other significant components of the folding station of the present invention;

FIG. 4E illustrates, in the same schematic perspective view, the components of FIG. 4D with some parts of the folding, station having been removed in order to evidence others which would otherwise be hidden from view.

DESCRIPTION OF THE PREFERRED EMBODIMENTS

With reference to the appended figures of the drawings, (S4) denotes the folding station for folding a cardboard blank about an article rested on the cardboard blank of the present invention, while reference numeral (100) denotes the machine for packaging an article internally of a cardboard box obtained from the cardboard sheet in its entirety, and comprising, among the various work stations, the folding station (S4).

The folding station (S4) of the present invention comprises an inlet (IN) for receiving a cardboard blank (C) having a first portion (P1), a first lateral closing wall (C1) hinged by a first transversal score line to a first transversal side of the first portion (P1), a second lateral closing wall (C2), hinged by a second transversal score line to a second transversal side, opposite the first side, of the first portion (P1), an upper closing wall (PS), hinged by a third transversal score line to the second lateral closing wall (C2), a third lateral closing wall (C3), hinged to a first longitudinal side of the first portion (P1), and having a folding tab (a2) hinged thereto by a longitudinal folding line (b), and a fourth lateral closing wall (C4), hinged to a second longitudinal side of the first portion (P1) and having a folding tab (a4) hinged thereto by a longitudinal folding line (d).

Figure 1A:
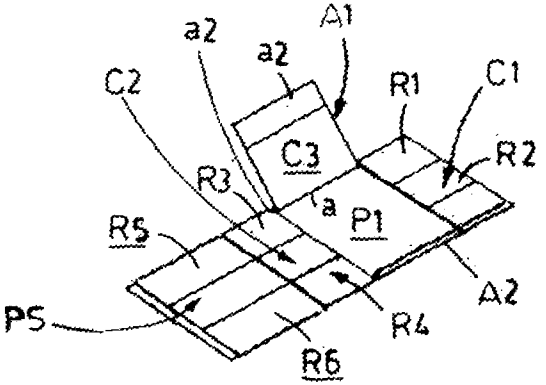
FIG. 1A, also mentioned in the foregoing, illustrates, in a perspective view, the cardboard blank with reinforced walls obtained by the cardboard blank of FIG. 1 following the folding of the reinforcing flaps above the respective portions present in the central sector (SC) of the cardboard blank; a cardboard blank of this type with an article arranged resting thereon is received in inlet and processed by the folding station of the present invention.

The folding station (S4) is for receiving, at the inlet (IN) thereof, a cardboard blank (C) such as the one illustrated in detail in FIG. 1A.

The inlet (IN) of the folding station (S4) receives the cardboard blank (C) which is arranged with the first lateral closing wall (C1) facing upstream and with the upper closing wall (PS) facing downstream, and with an article (D) to be packaged inside the cardboard blank (C) being arranged with the base wall thereof resting on the first portion (P1) with a first lateral flank facing upstream towards the first lateral closing wall (C1), a second lateral flank, opposite the first flank, facing towards the second lateral closing wall (C2), a third lateral flank, transversal to the first two, facing towards the third lateral closing wall (C3), and a fourth lateral flank, opposite the third, facing towards the fourth lateral closing wall (C4).

The folding station (S4) further comprises an outlet (OUT) for providing in outlet a cardboard box (SCA) constituted by the cardboard blank, partly folded about the article with the second, third and fourth lateral closing walls and the upper closing wall, and a conveyor (4), for example a conveyor belt, which extends from the inlet (IN) to the outlet (OUT) for conveying the cardboard blank (C) from the inlet (IN) to the outlet (OUT) according to an advancement direction (V).

The conveyor (4) is predisposed for receiving, at the inlet (IN), a packing cardboard blank (C) arranged with the first portion (P1) resting on the conveyor (4), the first lateral closing wall (C1) facing upstream and arranged on the same plane as the first portion (P1), the second lateral closing wall (C2) and the upper closing wall (PS) facing downstream and arranged on the same plane as the first portion (P1), with the third lateral closing wall (C3) and the fourth lateral closing wall (C4) in a partly raised position with respect to the first portion (P1) and projecting from the sides of the conveyor (4), and with an article (D) to be packed being arranged with the base wall thereof resting on the first portion (P1) with a first lateral flank facing upstream towards the first lateral closing wall (C1), a second lateral flank, opposite the first flank, facing towards the second lateral closing wall (C2), a third lateral flank, transversal to the first two, facing towards the third lateral closing wall (C3), and a fourth lateral flank, opposite the third, facing towards the fourth lateral closing wall (C4), and with the upper face facing upwards.

The folding station (S4) comprises, between the inlet (IN) and the outlet (OUT), a first folding zone (Z1) and a second folding zone (Z2) arranged downstream of the first folding zone (Z1), with the conveyor (4) being predisposed to transport the cardboard blank (C), with the article (D) rested by the base wall thereof on the first portion (P1) of the cardboard blank (C), through the first folding zone (Z1) and to the second folding zone (Z2).

The first folding zone (Z1) comprises first folding means (71), arranged by a first side of the conveyor (4), and second folding means (72) instead arranged by a flank of a second side of the conveyor (4).

The first folding means (71) are predisposed so as to abut the third lateral closing wall (C3) and the folding tab (a2) hinged thereto during the advancement of the cardboard blank (C) through the first folding zone (Z1) by the conveyor (4), and are for this configured so as, also during the advancement of the cardboard blank (C) by the conveyor (4), to rotate the third lateral closing wall (C3), with respect to the first portion (P1) on which the article (D) is placed, up to bringing the third lateral closing wall (C3) into a position facing the third lateral flank of the article (D) so as to cover it, and so as to rotate the folding tab (a2) about the longitudinal folding line (b) with which it is hinged to the third lateral closing wall (C3), and to fold the folding tab (a2) with respect to the third lateral closing wall (C3) up to arranging the folding tab (a2) above a part of the upper face of the article (D).

The second folding means (72) are predisposed so as to abut the fourth lateral closing wall (C4) and the folding tab (a4) hinged thereto during the advancement of the cardboard blank (C) through the first folding zone (Z1) by the conveyor (4), and are configured so as, also during the advancement of the cardboard blank (C) by the conveyor (4), to rotate the fourth lateral closing wall (C4), with respect to the first portion (P1) on which the article (D) is placed, up to bringing the fourth lateral closing wall (C4) into a position facing the fourth lateral flank of the article (D) so as to cover, it, and so as to rotate the folding tab (a4) about the longitudinal folding line (d) by which it is hinged to the fourth lateral closing wall (C4), and to fold the folding tab (a4) with respect to the fourth lateral closing wall (C4), up to arranging the folding tab (a4) above a part of the upper face of the article (D).

Figure 3A:
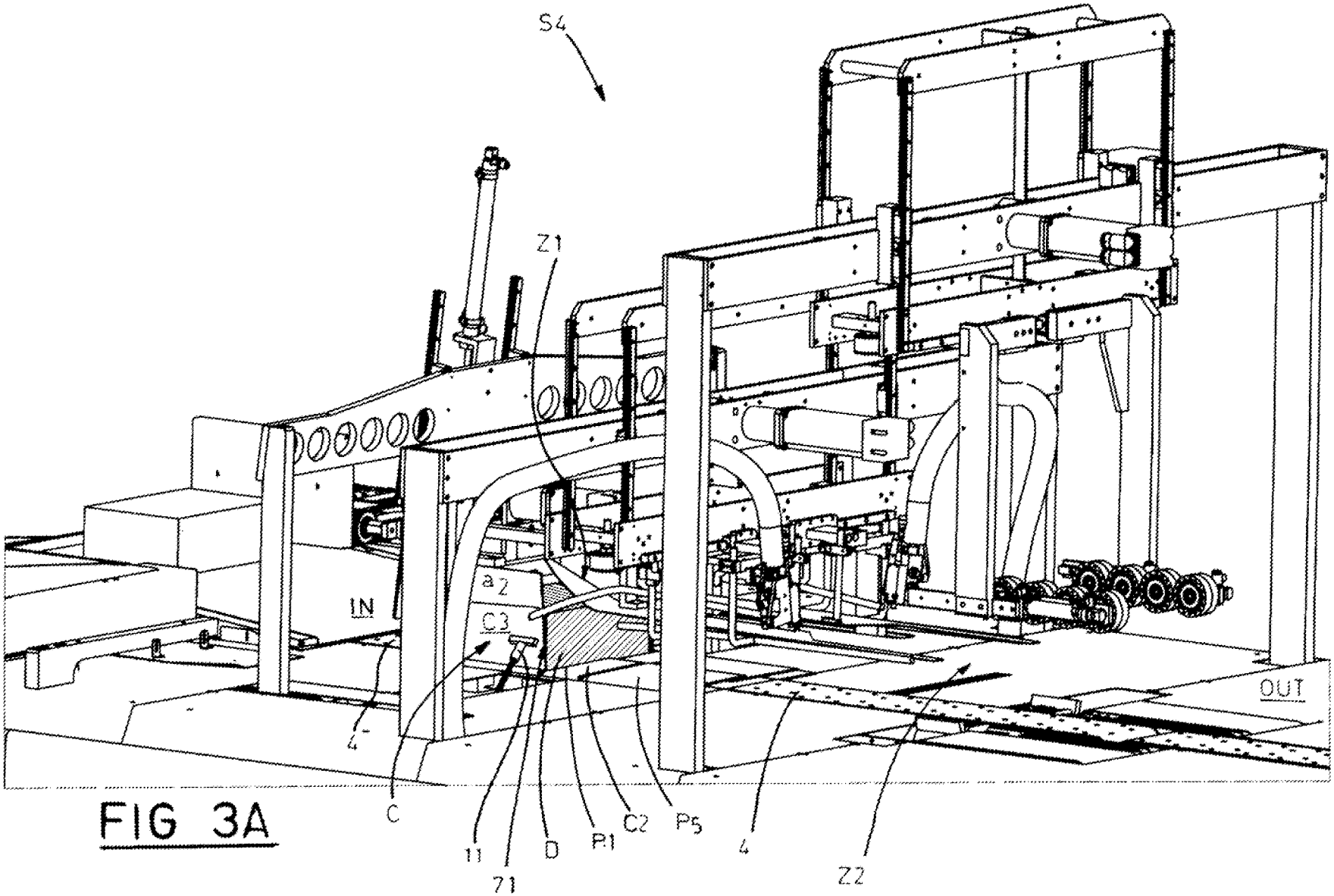
Figure 3B:
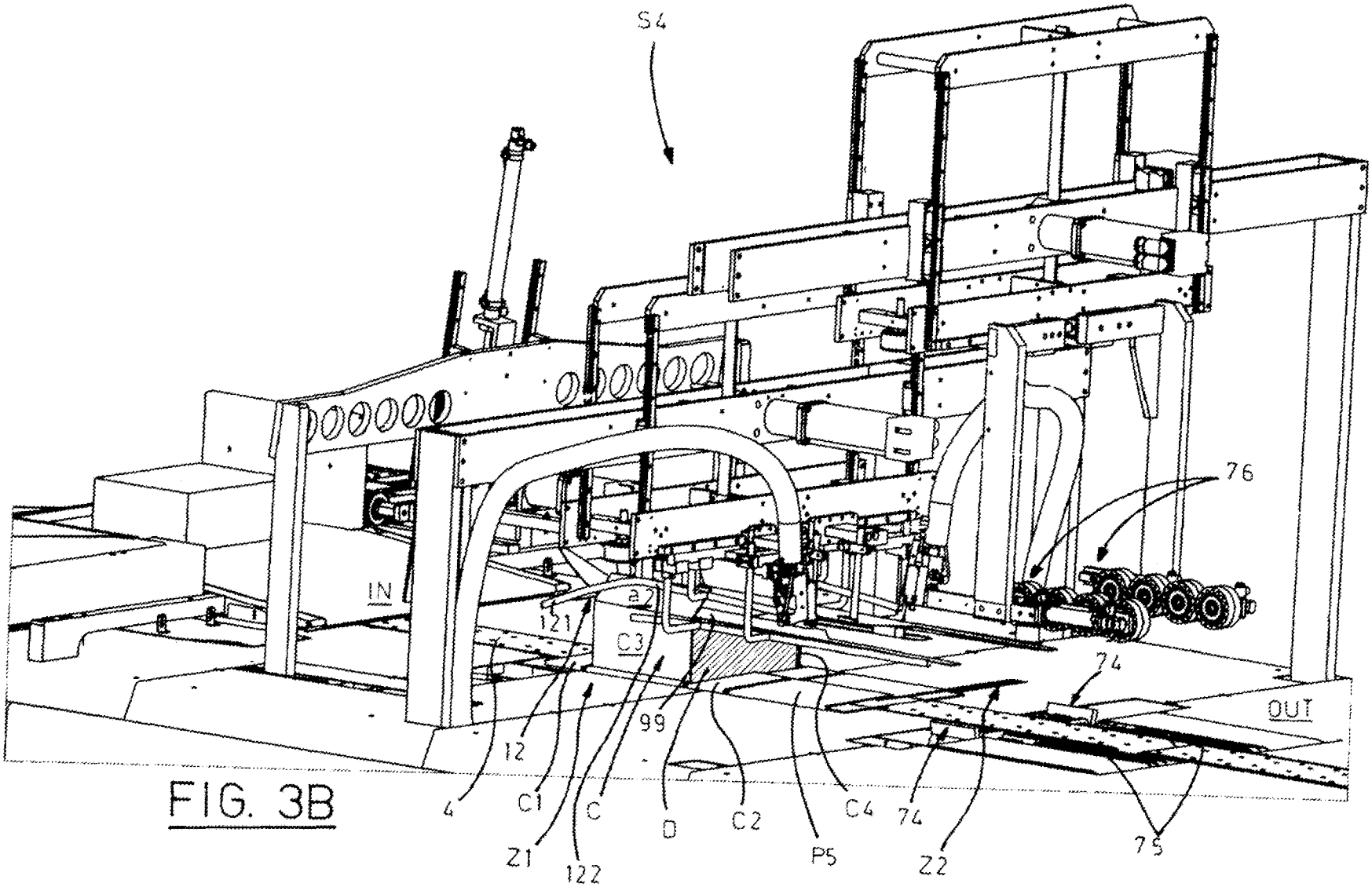
Figure 3C:
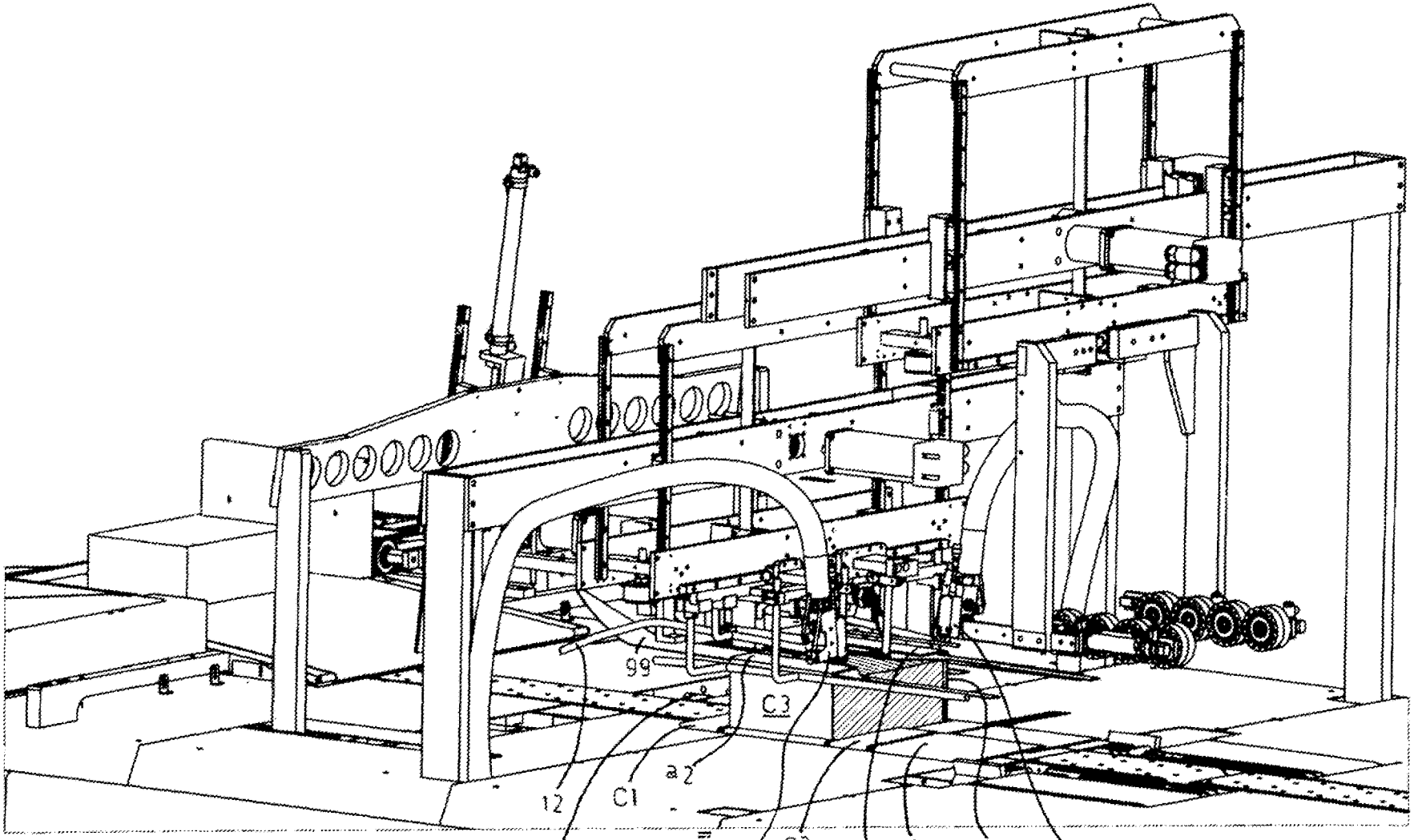

See for example FIGS. 3A, 3B and 3C which illustrate the above-described folding steps.

Figure 3D:
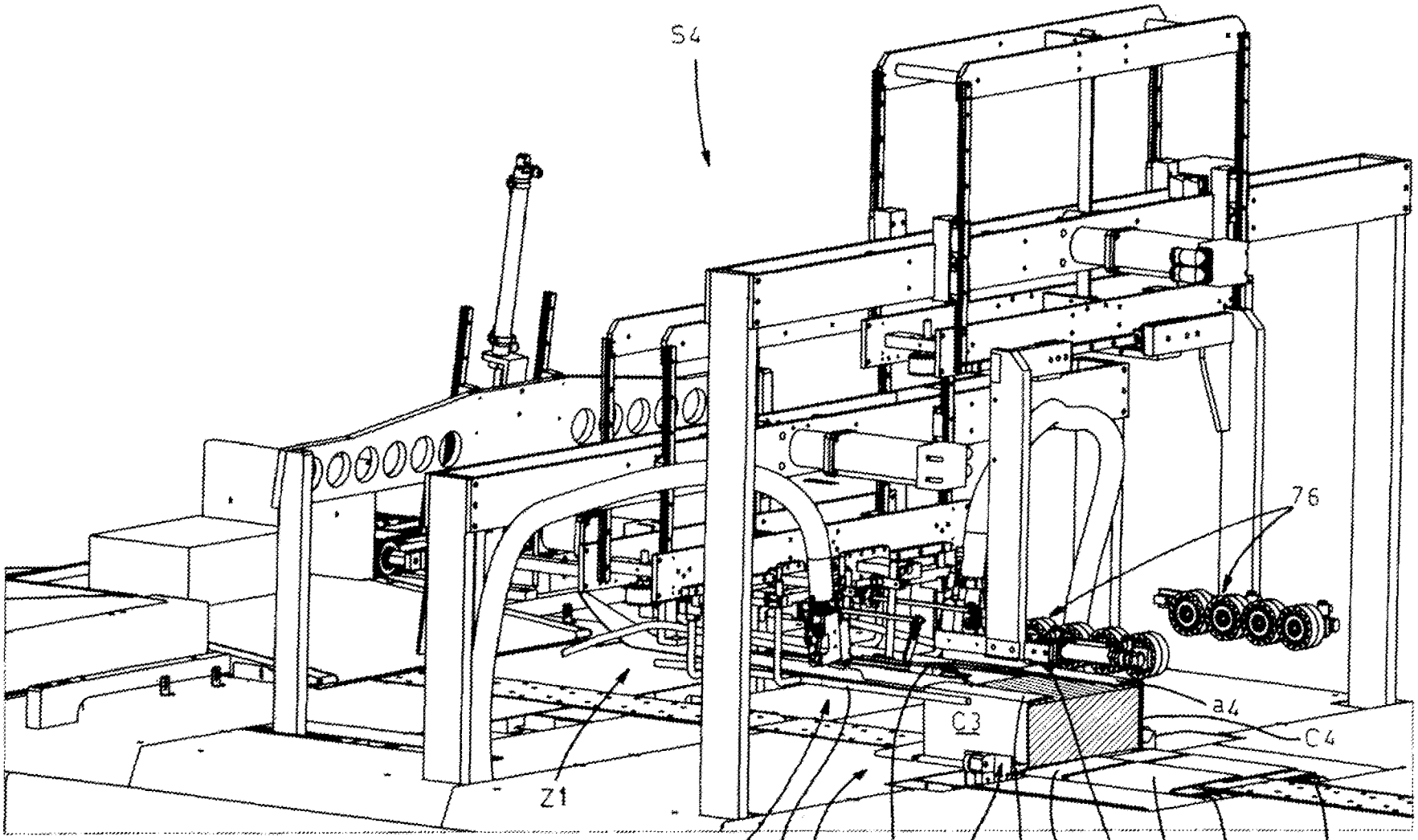
Figure 3E:
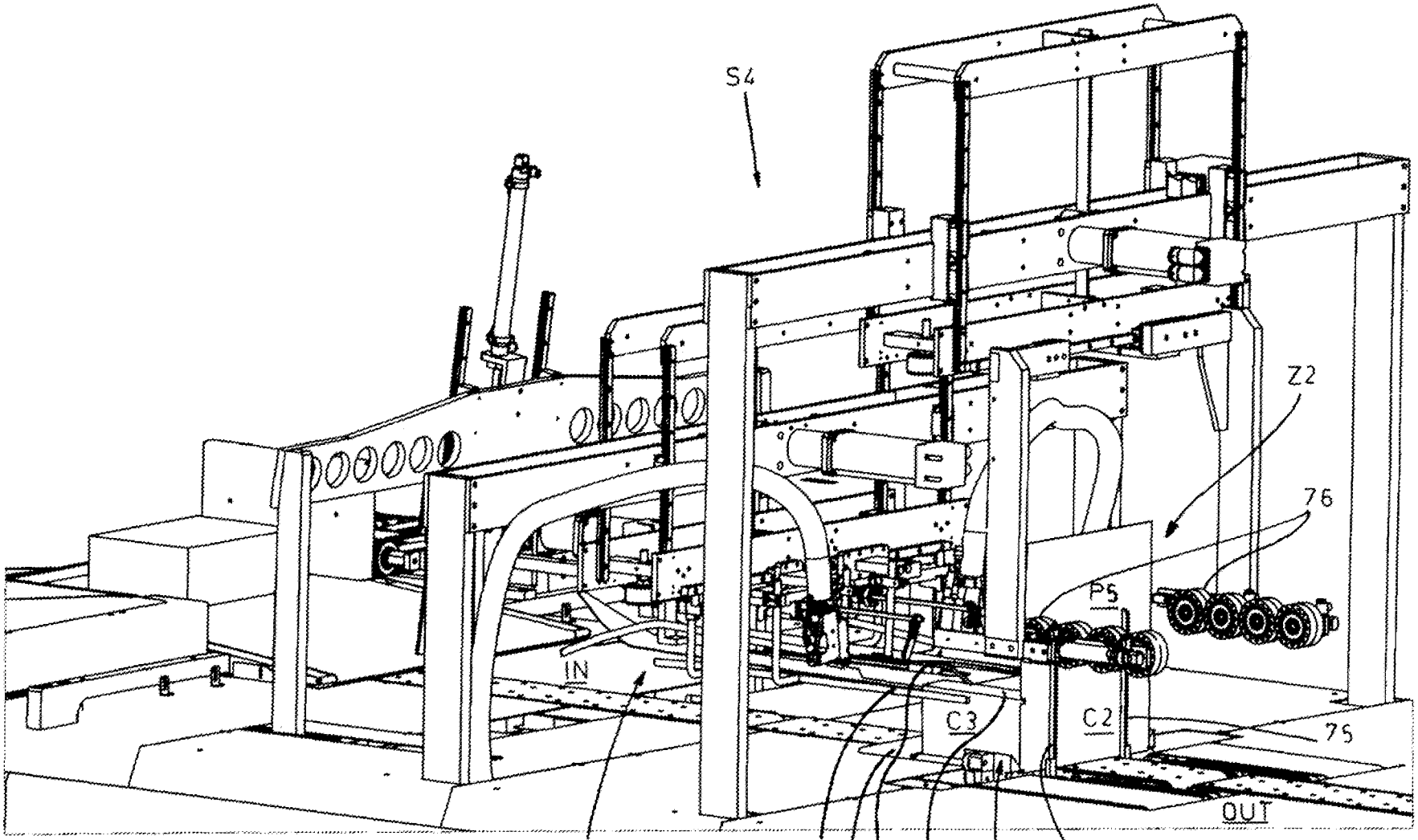
Figure 3F:
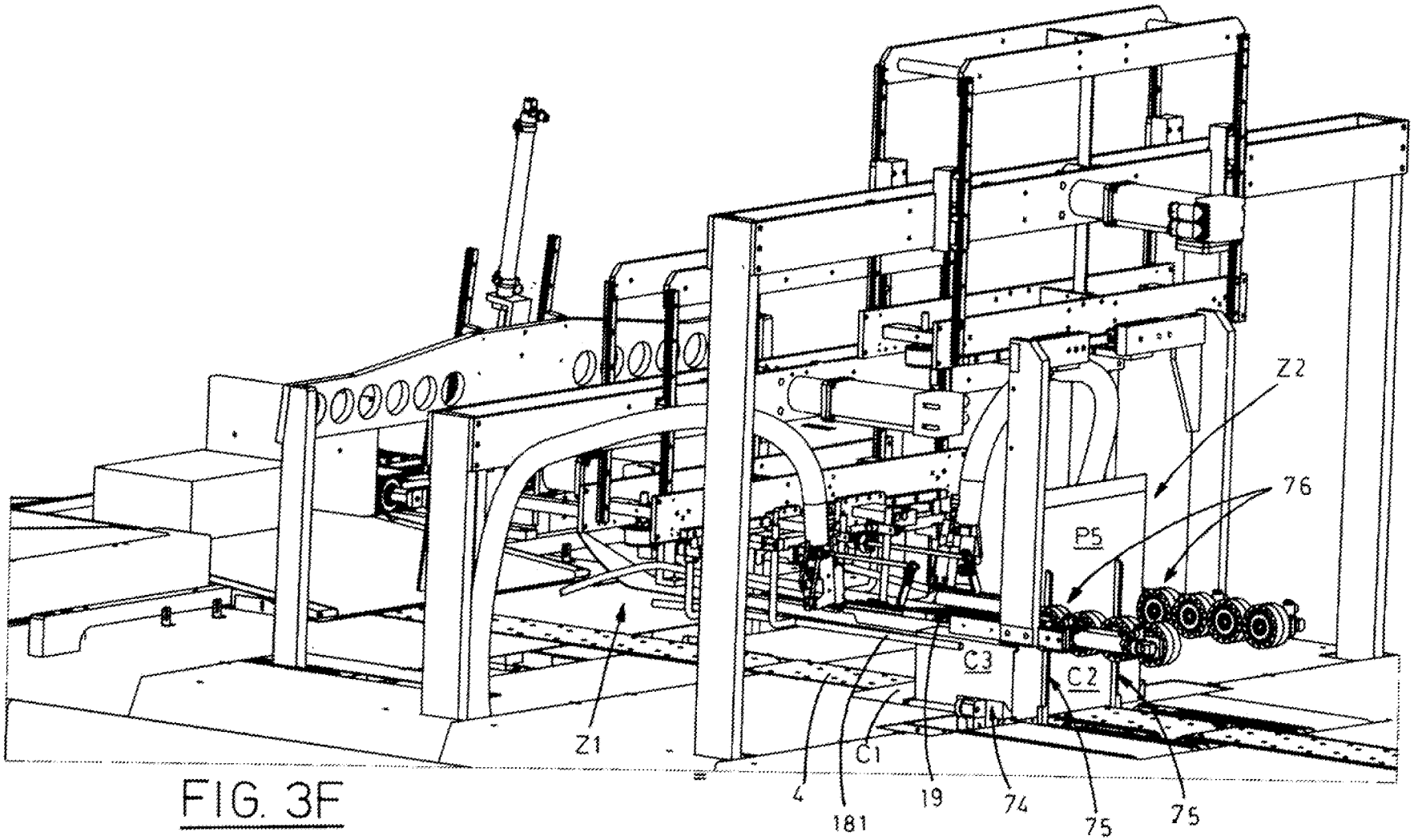
Figure 3G:
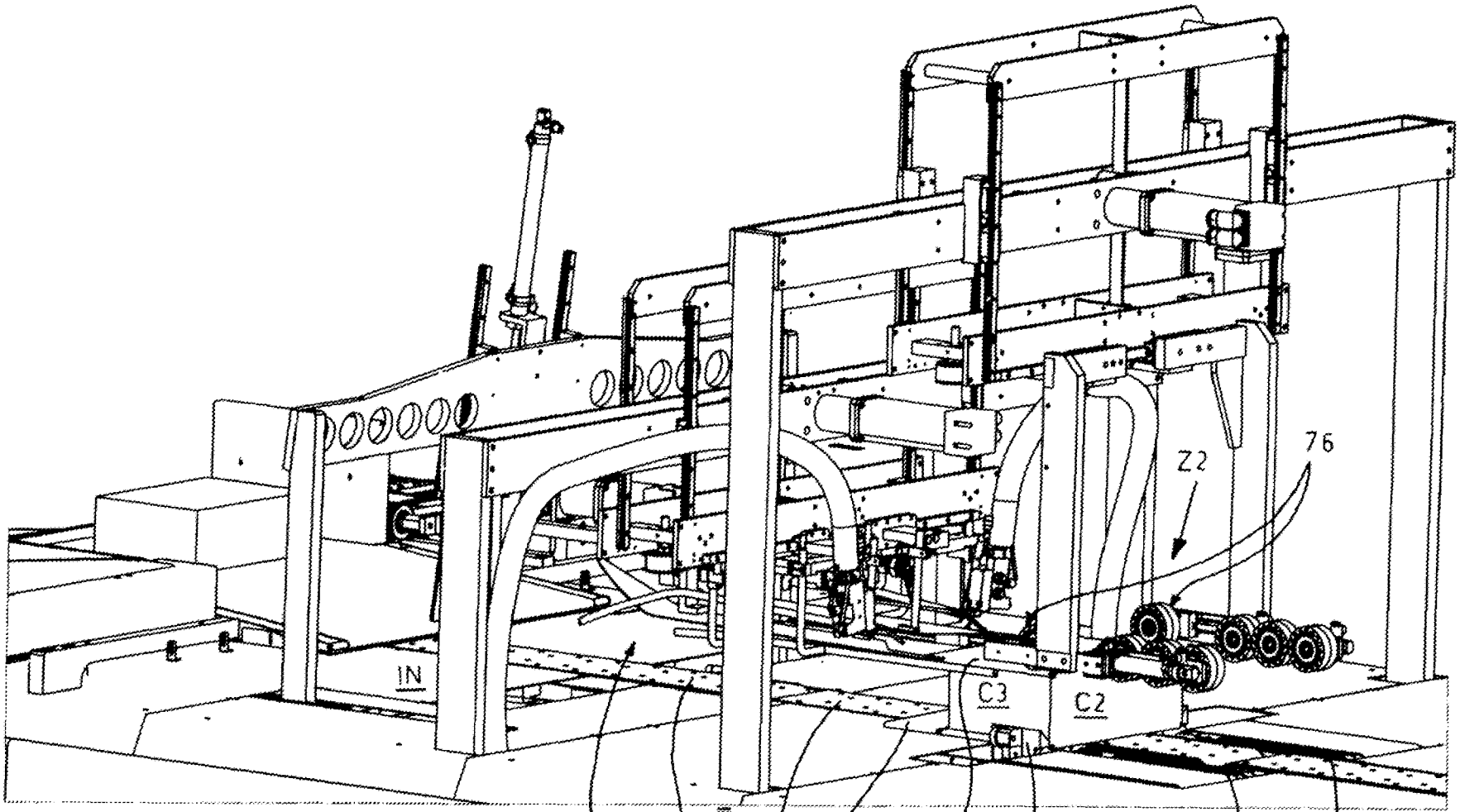
Figure 3H:
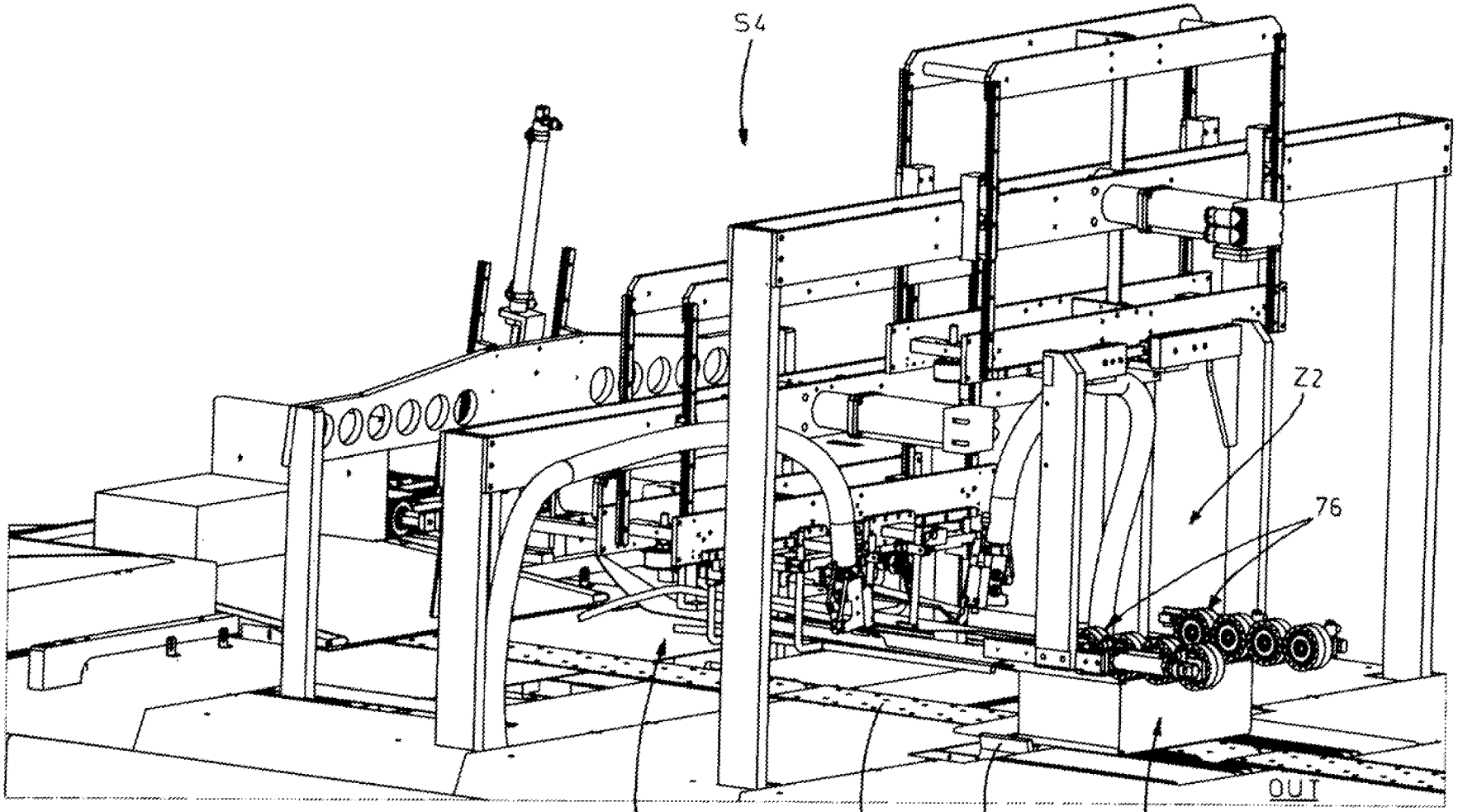

The second folding zone (Z2) comprises third folding means (75) which are predisposed at least by flanked to a side of the conveyor (4) so as to be able to rotate about a transversal axis of the conveyor (4) and activatable in rotation about the transversal axis, when the conveyor (4) takes the cardboard blank (C) into the second folding zone (Z2), so as to abut at least the second lateral closing wall (C2) and rotate it with respect to the first portion (P1) so as to fold the second lateral closing wall (C2) with respect to the first portion (P1) up to a position facing the second lateral flank of the article (D) so as to cover it and at the same time bring the upper closing wall (PS), hinged to the second lateral closing wall (C2), into a raised position with respect to the upper face of the article (D) placed resting on the first portion (P1) of the cardboard blank (C) (see in this regard FIGS. 3D, 3E and 3F):

The second folding zone (Z2) also comprises fourth folding means (76) which are predisposed above the conveyor (4) so as to be able to be lowered or raised with respect to the conveyor (4) so as to be positionable at a height corresponding to the position of the upper closing wall (PS) and which are further predisposed so as to be translatable in a parallel direction to the conveyor (4) so as to abut the upper closing wall (PS) and rotate it with respect to the second lateral closing wall (C2) so as to fold the upper closing wall (PS) with respect to the second lateral closing wall (C2) up to bringing it into a position facing and above the upper face of the article (D) so as to be arranged above the two folding tabs (a2, a4) previously folded above the upper face of the article (D) and above the upper face so as to cover it, and thus obtain a cardboard box (SCA) partially closed with the article packaged internally thereof (see in this regard FIGS. 3F, 3G and 3H).

With these characteristics the folding station (S4) proposed by the present invention is able to partly envelop the cardboard blank about the article rapidly and effectively, forming a cardboard box (SCA) that is partly closed and has the article (D) packaged internally thereof: the cardboard box (SCA) has three of the four lateral walls covering the lateral flanks of the article, and the upper wall covering the upper face of the article, and the base wall of the article rested on the first portion (P1), which constitutes the base wall of the box (SCA).

The box (SCA) will therefore have only one lateral wall, which is the first lateral closing wall (C1) and which remains to be folded so as to complete the closing of the box (SCA).

Further, owing to the fact that the fourth folding means (76) are predisposed so as to be able to be lowered or raised with respect to the conveyor (4) before being activated for the relative folding operations, the position and height thereof with respect to the conveyor can be adjusted on the basis of the effective dimensions of the article, in particular the height thereof, i.e. on the basis of the effective position and height of the upper closing wall (PS) with respect to the level of the conveyor (4).

Other advantageous and preferred characteristics of the folding station (S4) proposed by the present invention are described in the following.

The first folding means (71) comprise a pusher (I1) arranged by a flank of a first side of the conveyor (4), and a folding rod (12) having a curved head portion (121) and a straight body (122) inclined towards the conveyor (4) (see for example FIGS. from 4A to 4C).

The pusher (I1) is predisposed so as to be movable between a lowered position and a raised position for abutting the third lateral closing wall (C3) of the cardboard blank (C) and rotating it with respect to the first portion (P1) so as to bring it into a position facing the third lateral flank of the article (D) so as to cover it (see for example FIG. 3A).

The folding rod (12) is predisposed so that during the advancement of the cardboard blank (C) by the conveyor (4) through the first folding zone (Z1), the curved head portion (121) abuts the folding tab (a2) hinged to the third lateral closing wall (C3) and rotates it with respect to the third lateral closing wall (C3) while the inclined straight body (122) abuts the tab (a2) and rotates it and pushes it downwards to fold above the upper face of the article (D) (see FIGS. from 3A to 3C).

In turn, the second folding means (72) comprise a pusher (21) arranged by a flank of the second side of the conveyor (4), and a folding rod (22) having a curved head portion (221) and a straight body (222) inclined towards the conveyor (4) (visible for example in FIG. 4C).

The pusher (21) is predisposed so as to be movable between a lowered position (visible in FIG. 3C) and a raised position (not visible in the appended figures as covered by the article and by the cardboard blank folded about the article) for abutting the fourth lateral closing wall (C4) of the cardboard blank (C) and rotating it with respect to the first portion (P1) so as to bring it into a position facing the fourth lateral flank of the article (D) so as to cover it.

The folding rod (22) is predisposed so that during the advancement of the cardboard blank (C) by the conveyor (4) through the first folding zone (Z1), the curved head portion (221) abuts the folding tab (a4) hinged to the fourth lateral closing wall (C4) and rotates it with respect to the fourth lateral closing wall (C4) while the inclined straight body (222) abuts the tab (a4) and rotates it and pushes it downwards to fold on the upper face of the article (D).

A particularly advantageous aspect of the folding station (S4) of the invention consists in the fact that the folding rod (12) of the first folding means (71) and the folding rod (22) of the second folding means (72) are predisposed so as to be mutually nearable or mutually distanceable to/from one another so as to adjust the reciprocal position thereof on the basis of the actual dimension of the cardboard blank (C) and the actual position of the third lateral closing wall (C3) and of the fourth lateral closing wall (C4), and further predisposed so as to be raisable or lowerable with respect to the conveyor (4) so as to adjust the height thereof with respect to the conveyor (4) on the basis of the actual height of the third lateral closing wall (C3) and of the fourth lateral closing wall (C4).

In this way, on the basis of the effective dimensions of the article to be packed, and therefore also the relative dimensions of the cardboard blank on which the article is rested, it is possible, before the conveyor (4) advances the cardboard blank with the article through the first folding zone (Z1), to adjust the reciprocal distance between the two folding rods as well as the height thereof with respect to the conveyor, so as to adjust the position thereof with respect to the effective position and dimensions of the third (C3) and the fourth (C4) lateral closing walls.

For example, see FIG. 4A which illustrates a possible configuration and reciprocal configuration of the two folding rods at a given reciprocal distance from one another and at a given height with respect to the conveyor, and FIG. 4B which illustrates a different possible configuration and reciprocal configuration of the two folding rods which are closer to one another and in a more raised position with respect to the conveyor.

In particular, in the preferred embodiment illustrated in the appended figures, the folding station (S4) comprises a first frame (T10), predisposed above the conveyor (4) at the first folding zone (Z1), a second frame (T20), mounted on the first frame (T10) so as to be vertically slidable with respect to the first frame (T10), the folding rod (12) of the first folding means (71) and the folding rod (22) of the second folding means (72) being predisposed so as to be borne by the second frame (T20) and which are predisposed so as to be translatable with respect to the second frame (T20) so as to be translatable with respect thereto according to a transversal direction to the conveyor.

In greater detail, as is, for example, well visible in figures from 4A to 4C, the folding station (S4) comprises first horizontal sliding guides (5) predisposed on the second frame (T20) transversally to the conveyor (4) the folding rod (12) of the first folding means (71) and the folding rod (22) of the second folding means (72) being mounted on and borne by carriages (15) predisposed and coupled slidably on the first horizontal sliding guides (5).

Also comprised are first movement means (16) for vertical movement of the second frame (T20) with respect to the first frame (T10), which are predisposed for raising or lowering the second frame (T20) with respect to the first frame (T10) so as to adjust the height of the folding rods (12, 22) with respect to the conveyor (4) and adjust the position thereof to the actual height of the third lateral closing wall (C3) and of the fourth lateral closing wall (C4).

The movement means (16) can for example preferably comprise, in a possibly but not limiting embodiment, vertical guides (161) predisposed on the first frame (T10) and on which the second frame (T20) is slidably mounted, a branch of a belt (162) arranged vertically and constrained, at the two ends thereof, to opposite sides of the second frame (T20) and partly wound on a pulley (163) predisposed on the first frame (T10), and a motor organ (164) for activating the pulley (163) in rotation according to two opposite rotation directions.

The folding station (S4) further comprises second movement means (17) for moving the carriages (15), along the first horizontal sliding guides (5) of the second frame (T20), which are predisposed for translating the carriages (15) along the first horizontal sliding guides (5) so as to be able to mutually near or distance them to/from one another so as to be able to near or distance the folding rods (12, 22) to/from one another so as to adjust and regulate the reciprocal position thereof on the basis of the actual dimension of the cardboard blank (C) and the effective position of the third lateral closing wall (C3) and the fourth (C4) lateral closing walls with respect to the conveyor (4).

For example, in a possible but non-limiting embodiment realized in the figures (see for example figures from 4A to 4C), the second movement means (17) comprise a loop-wound belt (171) arranged horizontally and transversally of the conveyor (4) and borne by the second frame (T20), and wound on relative pulleys (173) (of which only one is visible) arranged with the vertical rotation axis, of which at least one pulley is activatable in rotation in two opposite rotation directions by a relative motor organ (172); the carriages (15) bearing the folding rod (12) of the first folding means (71) which are constrained to a first branch of the loop-wound belt (171) and with the carriages (15) bearing the folding rod (22) of the second folding means (72) which are constrained to an opposite second branch of the loop-wound belt (171).

The folding station (S4) further comprises, in the second folding zone (Z2), blocking means (74) which are predisposed so as to block the cardboard blank (C) at the second folding zone (Z2) and enable activation of the third folding means (75) for folding the second lateral closing wall (C2) and activation of the fourth folding means (76) for folding the upper closing wall (PS).

In particular, according to the preferred embodiment illustrated in the figures, the blocking means (74) comprise a pair of jaws (47) which are arranged bilaterally of the conveyor (4) and which are predisposed each to be rotatable each about a parallel axis to the conveyor (4) so as to be rotatable between a splayed configuration and a neared configuration so as to abut the third (C3) and the fourth (C4) lateral closing walls and block the cardboard blank (C) (see FIGS. from 3A to 3C, and 3H, where the jaws of the pair of jaws (47) are in the splayed configuration and FIGS. from 3D to 3G where the jaws (47) are in the neared position thereof for blocking the cardboard blank).

Further, in another advantageous aspect, the pair of jaws (47) are predisposed to be mutually nearable or distanceable to or from one another so as to adjust the reciprocal distance thereof with respect to the actual dimensions of the cardboard blank (C) and the actual distance between the third (C3) and the fourth (C4) lateral closing walls.

For example, in the preferred embodiment illustrated in FIG. 4E, the jaws (47) are borne by relative supports (470) which are constrained by carriages (474), mounted slidably on a horizontal and transversal sliding rail (475) beneath the conveyor (4), at the two opposite branches of a loop-wound belt (471) arranged transversally beneath the conveyor (4) and wound on relative pulleys (472) arranged with the relative rotation axis vertical and activatable in rotation, in two opposite rotation directions, by a motor organ (473), for moving the belt in two possible translation directions, so as to reciprocally near or distance the carriages (474) and therefore the supports (470) which bear the jaws (47), so as to be able to adjust the position and reciprocal distance thereof in order to regulate the position and distance to the effective dimensions of the cardboard blank (C).

The jaws (47) are hinged to the supports according to a hinge axis parallel to the conveyor and activatable in rotation about the hinge axis by means of relative actuator organs (476) such as for example pneumatic or hydraulic pistons.

The third folding means (75) provided in the second folding zone (Z2) comprise at least a pair of battens (57) arranged bilaterally of the conveyor (4) so as to be activatable in rotation about a transversal rotation axis to the conveyor (4) so as to be activatable in rotation from a lowered position, in which they are in a horizontal position at a level at most equal to the level of the conveyor (4) (see for example FIGS. from 3A to 3D), to a raised position, wherein they are in a vertical position, so as to be able to abut the second lateral closing wall (C2) and rotate it with respect to the first portion (P1) of the cardboard blank (C) on which the article (D) is rested so as to fold the second lateral closing wall (C2) with respect to the first portion (P1) up to a position facing the second lateral flank of the article (D) so as to cover it and at the same time bring the upper closing wall (PS), hinged to the second lateral closing wall (C2), into a raised position with respect to the upper face of the article (D) placed resting on the first portion (P1) of the cardboard blank (C) (see for example FIGS. from 3E to 3F).

In the preferred embodiment illustrated in FIG. 4E, the battens (57) are mounted on a common shaft (571) arranged transversally beneath the conveyor and activatable in rotation by actuator organs (572) such as for example pneumatic or hydraulic pistons.

The above-mentioned fourth folding means (76) provided in the second folding zone (Z2) comprise at least a pair of wheels (67) arranged bilaterally of and above the conveyor (4) and mounted idle about relative horizontal and transversal rotation axes to the conveyor (4).

The wheels (67) of the pair of wheels (67) are predisposed in such a way as to be mutually neared or distanced to/from one another so as to adjust the position thereof with respect to the conveyor (4) on the basis of the actual dimensions of the cardboard blank (C) and the actual dimensions and width of the upper closing wall (PS), and are also predisposed in such a way as to be lowered or raised with respect to the conveyor (4) so as to be positionable at a height corresponding to the position of the upper closing wall (PS) (FIG. 3F). Further, the wheels (67) of the pair of wheels (67) are predisposed so as to be translatable in a parallel direction to the conveyor (4) so as to abut the upper closing wall (PS) and rotate it with respect to the second lateral closing wall (C2) so as to fold the upper closing wall (PS) with respect to the second lateral closing wall (C2) up to bringing it into a position facing and above the upper face of the article (D) so that it is arranged above the two folding tabs (a2, a4) folded above the upper face of the article (D) and above the upper face so as to cover it (see FIGS. 3G and 3H).

In this regard, the folding station (S4) comprises a third frame (T30), predisposed above the conveyor (4) at the second folding zone (Z2), a fourth frame (T40), mounted on the third frame (T30) so as to be vertically slidable with respect to the third frame (T40), with the wheels (67) of the pair of wheels (67) being predisposed so as to be borne by the fourth frame (T40) and predisposed to be translatable with respect to the fourth frame (T40) so as to be translatable with respect thereto according to a transversal direction to the conveyor (4).

In particular, in the preferred embodiment illustrated in the appended figures, the folding station (S4) comprises second horizontal sliding guides (58) predisposed on the fourth frame (T40) transversally to the conveyor (4), while the wheels (67) of the pair of wheels (67) are mounted and borne by relative uprights (68) which are constrained and borne by carriages (69) predisposed and coupled slidably on the second horizontal sliding guides (58) provided on the fourth frame (T40).

Further comprised are third horizontal sliding guides (59) predisposed on the uprights (68) parallel to the conveyor (4) with the rotation axes of the wheels (67) of the pair of wheels (67) being borne by carriages (64) mounted slidably on the third horizontal sliding guides (59).

The folding station (S4) further comprises third movement means (36) for vertical movement of the fourth frame (T40) with respect to the third frame (T30), which are predisposed to raise or lower the fourth frame (T40) with respect to the third frame (T30) so as to adjust the height of the wheels (67) of the pair of wheels (67) with respect to the conveyor (4) and adjust the position thereof to the actual height of the upper closing wall (PS).

For example, the movement means (36) can comprise, in a possible but not limiting embodiment, vertical guides (361) predisposed on the third frame (T30) and on which the fourth frame (T40) is slidably mounted, a branch of a belt (362) arranged vertically and constrained, at the two ends thereof, to opposite sides of the fourth frame (T40) and partly wound on a pulley (363) predisposed on the third frame (T30), and a motor organ (364) for activating in rotation of the pulley (363) in two opposite rotation directions.

The folding station (S4) further comprises fourth movement means (37) for moving the carriages (69), along the second horizontal sliding guides (58) of the third frame (T30), which are predisposed for translating the carriages (69) along the second horizontal sliding guides (58) so as to near or distance them to/from one another so as to be able to near or distance the uprights (68) which bear the wheels (67) to/from one another, with the purpose of adjusting and regulating the position of the wheels (67) on the basis of the actual dimension of the cardboard blank (C) and the effective width of the upper closing wall (PS).

Also provided are fifth movement means (39) for translating the carriages (64), along the third horizontal sliding guides (59) predisposed on the uprights (68) parallel to the conveyor (4) so as to translate the wheels (67) parallel to the conveyor (4) and towards the upper closing wall (PS) so that the wheels abut the upper closing wall (PS) so as to rotate the upper closing wall (PS) with respect to the second lateral closing wall (C2) so as to fold the upper closing wall. (PS) with respect to the second lateral closing wall (C2) up to bringing it into a position facing and above the upper face of the article (D) so as to be arranged above the two folding tabs (a2, a4) folded above the upper face of the article (D) and above the upper face so as to cover it.

The fourth movement means (37) can for example comprise, in a preferred but not exclusive embodiment illustrated in the figures, a loop-wound belt (371) arranged horizontally and transversally of the conveyor (4) and borne by the fourth frame (T40), and wound on relative pulleys (373) (of which only one is visible in the figures) arranged with the relative vertical rotation axis, of which at least one pulley activatable in rotation in two opposite rotation directions by a relative motor organ (372); the carriage (69), bearing a first upright (68) of the uprights (68) on which a first wheel (67) of the pair of wheels (67) of the fourth folding means (76) is predisposed, which is constrained to a first branch of the loop-wound belt (371), the carriage (69), bearing a second upright (68) of the uprights (68) on which a second wheel (67) of the pair of wheels (67) is predisposed, which is constrained to a second branch of the loop-wound belt (371).

The fifth movement means (39) for the translation of the carriages (64) along the third horizontal sliding guides (59), predisposed on the uprights (68) parallel to the conveyor (4), comprise pneumatic or hydraulic pistons (390). Other and further aspects of the folding station of the invention are as follows. It comprises folding maintaining means (18) arranged between the first folding zone (Z1) and the second folding zone (Z2) and which are predisposed and configured so as to abut the third lateral closing wall (C3) and the fourth lateral closing wall (C4) and for maintaining them in the folded position thereof facing the third and fourth lateral flank of the article (D), and so as to abut the two folding tabs (a2, a4) folded on the upper face of the article (D) so as to maintain the two folding tabs (a2, a4) folded against the upper face during the transfer of the cardboard blank (C) by the conveyor (4) from the first folding zone (Z1) to the second folding zone (Z2) up to when the upper closing wall (PS) is folded and positioned on the upper face of the article (D).

The folding maintaining means (18) comprise a first horizontal bar (181) arranged by a flank of the folding rod (12) of the first folding means (71), externally thereof with respect to the conveyor (4), and predisposed so as to be borne and constrained to the carriages (15), slidably coupled on the first horizontal sliding guides (5) of the second frame (T20), so as to be externally in contact with the third lateral closing wall (C3) so as to maintain it pressed against the third lateral flank of the article (D) during the transfer of the cardboard blank (C) by the conveyor (4) from the first folding zone (Z1) up to the second folding zone (Z2); and a second horizontal bar (182) arranged by a flank of the folding rod (22) of the second folding means (72) externally thereof with respect to the conveyor (4), and predisposed so as also to be borne and constrained to the carriages (15) so as to be externally in contact with the fourth lateral closing wall (C4) in order to maintain it pressed against the fourth lateral flank of the article (D) during the transfer of the cardboard blank (C) by the conveyor (4) from the first folding zone (Z1) up to the second folding zone (Z2) (see for example figures from 3D to 3F).

The folding maintaining means (18) further comprise a pair of ribs (19) predisposed between the first horizontal bar (181) and the second horizontal bar (182) and so as to be borne and constrained to the carriages (15), slidable on the horizontal sliding guides (5) mounted on the second frame (T20), so as to be positioned in a position such as to be able to abut the two folding tabs (a2, a4) folded on the upper face of the article (D) and maintain them pressed against this upper face during the transfer of the cardboard blank (C) by the conveyor (4) from the first folding zone (Z1) up to the second folding zone (Z2).

The folding station (S4) is provided, at the first folding zone (Z1), with a pair of abutting plates (99) which are predisposed so as to be brought by the carriages (15) into a position internal of the two folding rods (12, 22), and such as to be positioned above the upper face of the article (D) so as to constitute an abutment for folding the two folding tabs (a2, a4).

The folding station lastly comprises glue applying means (73), predisposed between the first folding zone (Z1) and the second folding zone (Z2), and configured so as to apply glue on the folding tab (a2) folded with respect to the third lateral closing wall (C3) on the upper face of the article (D), and so as to apply glue on the folding tab (a4) folded with respect to the fourth lateral closing wall (C4), on the upper face of the article (D).

The glue applying means (73) comprise a pair of glue dispensing guns (73) which are predisposed so as to be borne and constrained to the carriages (15) mounted slidably on the first horizontal sliding guides (5) of the second frame (T20) so as to be positioned on the folding tabs (a2, a4) folded on the upper face of the article (D) so as to be able to dispense and apply glue on the folding tabs (a2, a4) during the transfer of the cardboard blank (C) by the conveyor (4) from the first folding zone (Z1) to the second folding zone (Z2) (see for example FIG. 3C in which the guns are dispensing the glue on the folding tabs).

As indicated in the preceding, in FIGS. 2A and 2B, in relative views from above and from the side, a layout of a machine (100) for packaging an article internally of a cardboard box is illustrated, obtained from a cardboard sheet of the present invention, and comprising the folding station (S4) described in the foregoing.

FIG. 2C and FIG. 2D schematically illustrate, in a succession of images, the various operations which the packaging machine (100) carries out starting from obtaining a cardboard sheet cut from a continuous strip of cardboard, for processing the cardboard sheet so as to obtain a cardboard blank for packaging, and the operations for wrapping the cardboard blank for packaging about an article and obtaining a closed cardboard box with the packaged article inside it.

In particular, FIG. 2C illustrates, with a series of images, some main operating steps of the machine of the invention, while FIG. 2D illustrates the complete succession of all the operating steps which the machine (100) performs for packaging an article internally of a cardboard box starting from a cardboard sheet cut from a continuous strip of cardboard, which operations include realising, starting from the cut cardboard sheet, a cardboard blank (C) such as the one illustrated in FIG. 1, and folding the cardboard blank about an article so as to package it and close it internally of a cardboard box.

The operating sequences illustrated in the succession of images in FIGS. 2C and 2D have been illustrated with reference to the packaging of two articles of different shapes and dimensions, and therefore both the cardboard blanks and the final boxes obtained in the two cases have a different shape and dimension.

This is also for demonstrating how the machine (100) of the present invention is able to package and close articles internally of the relative cardboard boxes independently of the dimensions of the articles, i.e. the machine (100) realises the cardboard for packaging on the basis of the effective dimensions of the articles so that the blanks can be folded about the articles and obtain the relative boxes with the packaged and packed articles internally of the boxes.

The machine (100) comprises:

- a store (M) in which a continuous strip of cardboard (S) is predisposed, folded in bellows fashion on itself to form a fanfold (SF);
- a sectioning station (S1) of a cardboard sheet (F) from the continuous strip of cardboard (S), which sectioning station (S1) is situated downstream of the store (M), and wherein the continuous strip of cardboard (S) unwound from the fanfold (SF) is fed and advanced in an advancement direction (w) and cut so as to obtain a cardboard sheet (F) and wherein at the same time a transversal score line (T4) is realised, parallel to the cut edge on the continuous strip of cardboard (S);
- a score line forming station (S1*), downstream of the sectioning station (S1), into which the cut cardboard sheet (F) is fed, coming from the sectioning station (S1), and on which cardboard sheet (F), the two longitudinal score lines (L1, L2) are realised, so as to identify, in the cardboard sheet, a central sector (SC) and two lateral sectors (SL1, SL2), and three transversal score lines (T1, T2, T3), for identifying, in the central sector (SC), together with the score line (T4) realised previously in the sectioning station (S1), the above described five portions (P1, P2, P3, P4, P5), and wherein in the portion of cardboard sheet of the two lateral sectors (SL1, SL2), two pairs of longitudinal folding lines (a, b) (c, d) are made at the flanks of the first portion (P1), which identify the first (a1), second (a2), third (a3) and fourth (a4) folding tabs of the two lateral folding flaps (A1, A2) from which the third (C3) and the fourth (C4) lateral closing walls of the cardboard blank are obtained.

In the score line forming station (S1*), the longitudinal score lines (L1, L2) and the transversal score lines (T1, T2, T3) are realised as a function of the effective dimensions of the article to be packed, in particular as a function of the dimensions of the base of the article (width L, length l) and of the height (H) of the flanks of the article.

In particular, for example, the two longitudinal score lines (L1, L2) are made at a mutual distance that is equal to the length (L) of the base of the article, the first transversal score line (T1) is made at a distance from a first transversal edge (B1) of the cardboard sheet (upstream edge with respect to the infeed direction into the score line forming station) corresponding to the height (H) of a first flank of the article, the second transversal score line (T2) is made at a distance from the first transversal score line (T1) on the basis of the width (l) of the base of the article, the third transversal score line (T3) is made at a distance from the second score line (T2) corresponding to the height (H) of the second flank of the article, opposite the first flank, and at a distance from the fourth transversal score line (T4), corresponding to the score line (T4) which had previously been realised in the sectioning station (S1), corresponding to the width (L*) of the upper face of the article.

The above-mentioned sectioning station (S1) of a cardboard sheet (F) from the continuous strip of cardboard (S) comprises: a conveyor plane (1), predisposed so as to be able to restingly receive the continuous strip of cardboard (S) which is unwound from the fanfold (F), conveying means (2), for advancing the continuous strip of cardboard (S) along the conveyor plane (1) in an advancement direction (w) and for halting the continuous strip of cardboard (S) for enabling cutting thereof, a sectioning group (3), predisposed above the conveyor plane (1), for sectioning and cutting a cardboard sheet (F) from the continuous strip of cardboard (S) and contemporaneously realising the score line (T4) in proximity of the cut edge (which will constitute the fourth score line (T4) in the cardboard sheet).

The score line forming station (S1*) comprises (FIGS. 2A, 2B):

first score line forming means (51) predisposed to realise, on the cardboard sheet (F), two longitudinal score lines (L1, L2) parallel to the advancement direction and parallel to the longitudinal edges (BL) of the cardboard sheet (F), distanced from one another by a distance corresponding to a length (L) of the base of the article to be packed, so as to identify, in the cardboard sheet (F), a central sector (SC) and two lateral sectors (SL1, SL2) (see for example the third image starting from the left in FIG. 2D);

second score line forming means (52) which are predisposed for realising, in the central sector (SC), the three transversal score lines (T1, T2, T3) parallel to one another and distanced so as to identify, in the central sector (SC), together with the fourth score line (T4) (which is the score line (T4) realised in the sectioning station (S1)), the above-mentioned five portions (P1, P2, P3, P4, P5) in the following way (see FIG. 1 and the fourth image starting from the left in FIG. 2D).

A first portion (P1), between the first transversal score line (T1) and the second transversal score line (T2) having dimensions corresponding to the base of the article to be packed;

a second portion (P2), between a first transversal edge (B1) of the cardboard sheet (F) and the first transversal score line (T1), having dimensions corresponding to a first flank of the article;

a third portion (P3), adjacent to the first portion (P1), between the second transversal score line (T2) and the third transversal score line (T3) having dimensions corresponding to a second flank of the article, opposite the first flank;

a fourth portion (P4), between the third score line (T3) and a fourth score line (T4) (which as mentioned is the score line (T4) that has been realised in the sectioning station (S1)) having dimensions corresponding to the upper face of the article;

and a fifth portion (P5) constituted by a strip of material of the cardboard sheet beyond the fourth transversal score line (T4) and up to the second transversal edge (B2) of the cardboard sheet (F), which will constitute the closing/opening tab (AC) of the cardboard box.

In particular, the second score line forming means (52) are predisposed for realising the three transversal score lines (T1, T2, T3) from a longitudinal edge 20. (BL) to the other longitudinal edge (BL) of the cardboard sheet (F), so that the transversal score lines involve also the two lateral sectors (SL1, SL2) of the cardboard sheet (F).

The score line forming station (S1*) lastly further comprises third score line forming means (53) which are predisposed so as to realise, in the portions of the cardboard sheet (F) of the two lateral sectors (SL1, SL2), at flanks of the first portion (P1), pairs of longitudinal folding lines (a, b), (c, d) parallel to the two folding lines (L1, L2) and having a same width extension as the first portion (P1).

The machine further comprises a transversal cutting station (S2), downstream of the score line forming station (S1*), into which the cardboard sheet (F) is fed in an advancement direction with the longitudinal score lines (L1, L2) and the four transversal score lines (T1, T2, T3, T4) and the pairs of folding lines (a, b), (c, d), into which cutting station (S2), for each of the two lateral sectors (SL1, SL2) four transversal cuts (I1; I2, I3, I4) are made on the cardboard sheet at the four transversal score lines (T1; T2, T3, T4), each at a relative transversal score line.

The transversal cutting station (S2) will provide, at the outlet thereof, as mentioned above, a cardboard blank for packaging (C) such as the one illustrated in the foregoing and illustrated in FIG. 1, that is, with the five portions (P1, P2, P3, P4, P5) in the central sector (SC), the six reinforcing flaps (R1, R2, R3, R4, R5, R6) in the two lateral enveloping flaps (A1, A2) in the two lateral sectors (SL1, SL2) (see also FIGS. 2C and 2D).

The transversal cutting station (S2) comprises cutting means (41, 42), for example constituted by two pairs of rotary cutting dies (41, 42) arranged on both sides of the cardboard sheet (F) for carrying out four transversal cuts (I1, I2, I3, I4) for each of the two lateral sectors (SL1, SL2) of the cardboard sheet (F), at the four transversal score lines (T1, T2, T3, T4), so as to obtain: at the two ends of the second portion (P2), a first reinforcing flap (R1) and a second reinforcing flap (R2); at the two ends of the first portion (P1), a first lateral enveloping flap (A1), containing the first pair of longitudinal folding lines (a, b) which identify a first folding tab (a1) between the folding line (a) and the first longitudinal score line (L1), a second folding tab (a2) between the folding line (b) and the edge of the first enveloping flap (A1), and a central part (C3) between the two longitudinal folding lines (a, b), and a second lateral enveloping flap (A2), containing the second pair of longitudinal folding lines (c, d) which identify a third folding tab (a3), between the folding line (c) and the second longitudinal score line (L2), a fourth folding tab (a4) between the folding line (d) and the edge of the second enveloping flap (A2) and a central portion (C4) between the two longitudinal folding lines (c, d); at the two ends of the third portion (P3), a third reinforcing flap (R3) and a fourth reinforcing flap (R4); at the two ends of the fourth portion (P4), a fifth reinforcing flap (R5) and a sixth reinforcing flap (R6); and forming, between the fourth transversal score line (T4) and the second transversal edge (B2), a tab (AC) for closing the cardboard box, so as to provide, at the outlet of the transversal cutting station (S2), a cardboard blank (C) for packing an article.

Downstream of this cutting station (S2), the machine (100) further comprises a successive series of work stations for carrying out the operations on the cardboard blank (C) that are necessary for realising the packaging of the article internally of a box obtained from the cardboard blank.

In detail, downstream of the transversal cutting station (S2), the machine (100) comprises, in succession one after another: a first folding station (S3), a feeding station (S3*) of the article to be packed, a second folding station (S4), for the partial folding of the cardboard blank about the article, which is realised like the folding station of the present invention and described in detail in the foregoing, and a closing station (S5) for the final folding of the cardboard blank about the article so as to obtain a closed cardboard box with the article inside, completely packed and packaged (see FIGS. 2A, 2B).

The first folding station (S3) is arranged downstream of the transversal cutting station (S2), into which the cardboard blank (C) is fed in an advancement direction and at which the cardboard blank (C) is halted and, simultaneously, i.e. in a single operation:

the first (R1) and second reinforcing flap (R2) are folded, with respect to the first (L1) and the second (L2) longitudinal score line, on the second portion (P2) of the central sector (SC), for obtaining the first lateral closing wall (C1);

the third (R3) and fourth reinforcing flap (R4), with respect to the first (L1) and the second (L2) longitudinal score line, on the third portion (P3) of the central sector (SC), for obtaining a second lateral closing wall (C2);

the fifth (R5) and sixth reinforcing flap (R6), with respect to the first (L1) and the second (L2) longitudinal score line, on the fourth portion (P4) of the central sector (SC), for obtaining an upper closing wall (PS);

the first folding tab (a1) of the first lateral enveloping flap (A1) is folded, with respect to the first longitudinal score line (L1), for superposing on a part of the first portion (P1) of the central sector (SC) and forming a reinforcing edge, leaving the central part (C3) of the first enveloping flap (A1) in the raised position, defining a third lateral closing wall (C3), and the third folding tab (a3) of the second lateral enveloping flap (A2) is folded, with respect to the second longitudinal score line (L2), for superposing a part of the first portion (P1) of the central sector (SC) and forming a reinforcing edge, leaving the central part (C4) of the second lateral enveloping flap (A2) in the raised position, so as to define a fourth lateral closing wall (C4) (see FIG. 1A, the fifth image from the left in FIG. 2C and the seventh image from the left in FIG. 2D).

As mentioned, these folding operations are carried out, as described in the foregoing, with the cardboard blank and simultaneously with one another, i.e. in a single action, therefore very rapidly and swiftly, required truly short pause times for the cardboard blank.

In this regard, the machine (100), in this first folding station (S3), comprises a first folding bar (61), arranged at a first side of the cardboard blank and rotatable about a rotation axis that is parallel to the advancement direction of the cardboard blank (C) so as to abut the first reinforcing flap (R1), the first folding tab (a1) of the first enveloping flap (A1), the third reinforcing flap (R3) and the fifth reinforcing flap (R5) present in the first lateral sector (SL1) of the cardboard blank (C), and to rotate them about the first longitudinal score line (L1) so as to fold and arrange them respectively: the first reinforcing flap (R1) above the second portion (P2) of the central sector (SC); the first folding tab (a1) above a part of the first portion (P1) of the central sector (SC); the third reinforcing flap (R3) above the third portion (P3) of the central sector (SC) and the fifth reinforcing flap (R5) above the fourth portion (P4) of the central sector (SC).

Figure 1B:
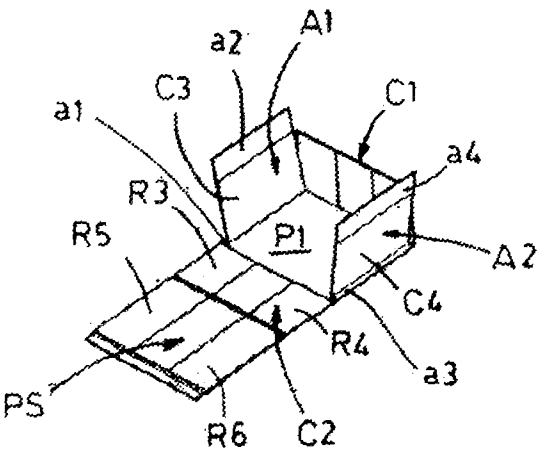
Figure 1C:
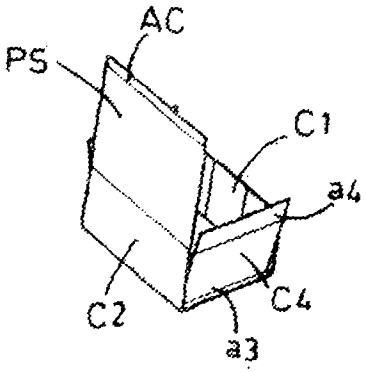
Figure 1D:
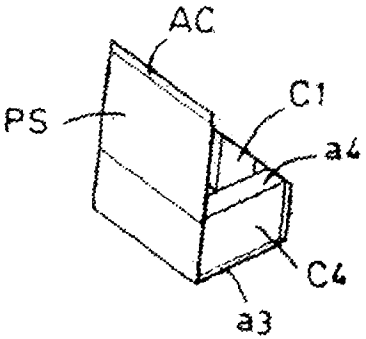
Figure 1E:
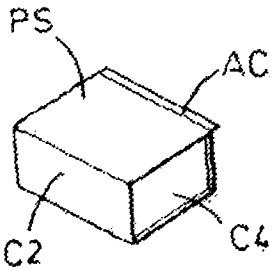
Figure 1F:
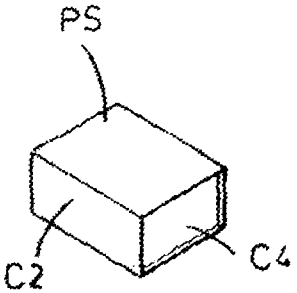

The machine (100) further comprises, once more in the first folding station (S3), also a second folding bar (62) arranged by a flank of the second side of the cardboard blank and which is rotatable about a rotation axis parallel to the advancement direction of the cardboard blank (C) so as to abut the second reinforcing flap (R2), the third folding tab (a3) of the second enveloping flap (A2), the fourth reinforcing flap (R4) and the sixth reinforcing flap (R6) present in the second lateral sector (SL2) of the cardboard blank (C), in order to rotate them about the second longitudinal score line (L2) so as to fold and arrange them respectively: the second reinforcing flap (R2) above the second portion (P2) of the central sector (SC); the third folding tab (a3) above a part of the first portion (P1) of the central sector (SC); the fourth reinforcing flap (R4) above the third portion (P3) of the central sector (SC) and the sixth reinforcing flap (R6) above the fourth portion (P4) of the central sector (SC), At the outlet of the first folding station (S3), the cardboard blank (C) has, formed upon it, the first lateral closing wall (C1), the second lateral closing wall (C2), the upper closing wall (PS), which all have a reinforced structure thanks to the reinforcing flaps folded and partially superposed on one another, and which are on the same plane as the first portion (P1) of the cardboard blank, while the third (C3) and fourth (C4) lateral closing wall are already partially erected and folded with respect to the central portion (P1) following the folding of the first folding tab (a1) and third folding tab (a3) above the first portion (P1), with the cardboard blank having the shape illustrated in the fifth image from the left in FIG. 2C, and also illustrated in FIG. 1B).

Downstream of this first folding station (S3), the machine (100) comprises a feeding station (S3*) of an article to be packed (see FIGS. 2A, 2B and 2D), at which an article to be packed is deposited and rested, by the base walls thereof, on the first portion (P1) of the cardboard blank (C) (FIG. 2D), with a first flank facing towards the first lateral closing wall (C1), a second flank, opposite the first, facing towards the second lateral closing wall (C2), a third flank, transversal to the first two, facing towards the third lateral closing wall (C3), and a fourth flank, opposite the third, facing towards the fourth lateral closing wall (C4).

At this point, the machine (100) further comprises, downstream of the inserting station of the article (S3*), a second folding station (S4) which is realised in the same way as the above-described folding station and object of the invention, to which the cardboard blank (C) with the article rested thereon, on the first portion (P1) thereof, is fed and advanced in an advancement direction. In the second folding station (S4), the cardboard blank (C) is advanced in the advancement direction, and while the cardboard blank (C) is in motion through the first folding zone (Z1), at the same time (see for example the third-last image of FIG. 2C, or the pair of the flanked two third-last images of FIG. 2D):

the third lateral closing wall (C3) is folded with respect to the folding line (a) which separates it from the first folding tab (a1) so as to cover the third flank of the article, and the second folding tab (a2) is folded with respect to the score line (b) which separates it from the third lateral closing wall (C3), so as to superpose it on a part of the upper face of the article, and the fourth lateral closing wall (C4) is folded with respect to the score line (c) which separates it from the third folding tab (a3) so as to cover the fourth flank of the article, and the fourth folding tab (a4) is folded with respect to the score line (d) which separates it from the fourth lateral closing wall (C4), so as to superpose it on a part of the upper face of the article.

These folding operations, as mentioned, are carried out by advancing the cardboard blank along an advancement direction, and as soon as these folding operations have been completed, the machine (100) applies glue on the second (a2) and fourth (a4) folding tabs folded onto the upper face of the article.

The machine (100) also includes, again in the second folding station (S4), and once the glue has been applied, halting the cardboard blank in the second folding zone (Z2) and (see for example the penultimate image of FIG. 2 or the pair of the two penultimate images of FIG. 2D):

rotating the second lateral closing wall (C2), with respect to the second transversal score line (T2), so as to fold it with respect to the first portion (P1) on which the article (for example folded by 90°) is rested up to when it goes to cover the second flank of the article, and then, in sequence, rotating the upper closing wall (PS), with respect to the third transversal score line (T3), so as to fold it with respect to the second lateral closing wall (C2) (for example folded by 90°) up to when it goes to cover the upper face of the article.

For this purpose, the machine (100) comprises, in this second folding station (S4) (see FIGS. 2A, 2B):

the first folding means (71) for rotating the third lateral closing wall (C3) and folding the third lateral closing wall (C3) up to when it goes to cover the third flank of the article, and for rotating the second folding tab (a2), with respect to the score line (b) which separates it from the third lateral closing wall (C3), and folding the second folding tab (a2) up to superposing it on a part of the upper face of the article;

the second folding means (72) for rotating the fourth lateral closing wall (C4), and folding the fourth lateral closing wall (C4) up to when it goes to cover the fourth flank of the article, and for rotating the fourth folding tab (a4), with respect to the score line (d) which separates it from the fourth lateral closing wall (C4), so as to fold the fourth folding tab (a4) up to superposing it on a part of the upper face of the article;

the glue applying means (73) being predisposed for applying glue on the second (a2) and fourth (a4) folding tab folded onto the upper face of the article;

the blocking means (74), for blocking and halting the cardboard blank (C) once the glue applying means (74) have applied the glue;

third folding means (75) for rotating the second lateral closing wall (C2), so as to fold it with respect to the first portion (P1) on which the article is rested up to when it goes to cover the second flank of the article, and fourth folding means (76) for rotating, in succession, following the folding of the second lateral closing wall (C2), the upper closing wall (PS) so as to fold it with respect to the second lateral closing wall (C2) up to when it goes to cover the upper face of the article, and therefore provide in outlet from the second folding station (S4) a cardboard box (SCA) partially closed with the packed article internally thereof.

At this point, at the outlet (OUT) of the second folding station (S4), the article is almost completely enveloped in the folded cardboard blank and the almost concluded packaging box.

The machine (100), therefore, transfers the cardboard blank (C), partly folded about the article in the above-described way, to the final closing station (S5), situated downstream of the second folding station (S4), at which the cardboard blank is halted, the first lateral closing wall (C1) is rotated with respect to the first transversal score line (T1) and folded with respect to the first portion (P1) (for example by 90°) so that it goes to cover the first flank of the article; at the same time as the folding of the first lateral closing wall (C1), glue is applied on the upper part of the first lateral closing wall (C1) (see the image on the left of the pair of last two images of FIG. 2D).

Lastly, following the completion of these operations, the machine (100), while still keeping the cardboard blank stationary in the final closing station (S5), rotates the closing tab (AC) with respect to the fourth transversal score line (T4), and folds the closing tab (AC) with respect to the upper wall (PS) (for example by 90°) against the upper part of the first lateral closing wall (C1), to make it adhere thereto and complete the closure of the cardboard box with the packaged article internally thereof (see the last image of FIG. 2C and the image on the right of the pair of two further images of FIG. 2D).

For this purpose, the machine (100), in this final closing station (S5), comprises (see FIGS. 2A, 2B):

stop means (8) activatable for halting the cardboard box (SCA);

fifth folding means (81) predisposed for being activated once the box (SCA) has been halted for rotating the first lateral closing wall (C1), with respect to the first transversal score line (T1), so as to fold it with respect to the first portion (P1) on which the article is rested so that it goes to cover the first flank of the article;

a glue applying organ (82), functionally associated to the fifth folding means (81), and predisposed for applying glue on a part of the first lateral closing wall (C1) while it is folded by the fifth folding means (81) against the first flank of the article, and sixth folding means (83) activatable for rotating the closing tab (AC) with respect to the fourth transversal score line (T4), and folding the closing tab (AC) with respect to the upper wall (PS) against the upper part of the first lateral closing wall (C1) on which the glue had been applied, in order to make it adhere thereto and complete the closing of the cardboard box (SCA) with the article packed internally thereof, and therefore provide at the outlet of the final closing station (S5) a cardboard box (SCA) completely closed with the packed article internal thereof.

The machine (100) then transfers the cardboard box, with the packaged article inside, to the outlet of the final closing station (S5), so that the cardboard box can be collected and directed towards a station for management and dispatch of orders.

The machine (100) further comprises, between the transversal cutting station (S2) and the first folding station (S3), also a trimming station (S2*), in which the cardboard blank can be trimmed along the longitudinal edges so as to adapt the width of the reinforcing flaps (R1, R2, R3, R4, R5, R6) to the effective dimensions of the second (P2), third (P3) and fourth portion (P4), so that the reinforcing flaps can effectively be folded above the portions, and at least partially superposed on one another, so as to adapt the width of the two lateral folding flaps (A1, A2), to the effective dimension of the third flank and fourth flank of the article.

The machine (100) also comprises, again between the transversal cutting station (S2) and the first folding station (S3), downstream of the trimming station (S2*), a glue applying station (S2**) comprising means for applying glue at least on reinforcing flaps (R1, R2, R3, R4, R5, R6) and/or on the second portion (P2), third portion (P3) and fourth portion (P4), on which the reinforcing flaps (R1, R2, R3, R4, R5, R6) have to be folded in the following first folding station (S3).

The invention claimed is:

1. A folding station for folding a packing cardboard blank about an article resting on the cardboard blank, the cardboard blank having a first portion, a first lateral closing wall, hinged to a first transversal side of the first portion, a second lateral closing wall, hinged to a second transversal side, opposite the first side, of the first portion, an upper closing wall, hinged to the second lateral closing wall, a third lateral closing wall, hinged to a first longitudinal side of the first portion, and having a folding tab hinged thereto by a longitudinal folding line, and a fourth lateral closing wall, hinged to a second longitudinal side of the first portion and having a folding tab hinged thereto by a longitudinal folding line, the folding station comprising an inlet, an outlet and a conveyor which extends from the inlet to the outlet, wherein the conveyor is predisposed for receiving, at the inlet, the packing cardboard blank arranged with the first portion resting on the conveyor, the first lateral closing wall facing upstream and arranged on the same plane as the first portion, the second lateral closing wall and the upper closing wall facing downstream and arranged on the same plane as the first portion, with the third lateral closing wall and the fourth lateral closing wall in a partly raised position with respect to the first portion and projecting from the sides of the conveyor, and with an article to be packed being arranged with the base wall thereof resting on the first portion with a first lateral flank facing upstream towards the first lateral closing wall, a second lateral flank, opposite the first flank, facing towards the second lateral closing wall, a third lateral flank, transversal to the first and second lateral flank, facing towards the third lateral closing wall, and a fourth lateral flank, opposite the third lateral flank, facing towards the fourth lateral closing wall, and with the upper face of the article facing upwards;

the folding station further comprising:

between the inlet and the outlet, a first folding zone and a second folding zone arranged downstream of the first folding zone, with the conveyor being predisposed to transport the cardboard blank, with the article rested by the base wall thereof on the first portion of the cardboard blank, through the first folding zone and to the second folding zone, the first folding zone comprising:

first folding means arranged by a first flank of the conveyor;

second folding means arranged by a second flank of the conveyor;

the first folding means being predisposed so as to abut the third lateral closing wall and the folding tab hinged thereto during the advancement of the cardboard blank through the first folding zone by the conveyor, and being configured so as, also during the advancement of the cardboard blank by the conveyor, to rotate the third lateral closing wall, with respect to the first portion on which the article is placed, up to bringing the third lateral closing wall into a position facing the third lateral flank of the article so as to cover the third lateral flank of the article, and so as to rotate the folding tab about the longitudinal folding line, and to fold the folding tab with respect to the third lateral closing wall up to arranging the folding tab above a part of the upper face of the article, the second folding means being predisposed so as to abut the fourth lateral closing wall and the folding tab hinged thereto during the advancement of the cardboard blank through the first folding zone by the conveyor, and being configured so as, also during the advancement of the cardboard blank by the conveyor, to rotate the fourth lateral closing wall, with respect to the first portion on which the article is placed, up to bringing the fourth lateral closing wall into a position facing the fourth lateral flank of the article so as to cover the fourth lateral flank of the article, and so as to rotate the folding tab about the longitudinal folding line, and to fold the folding tab with respect to the fourth lateral closing wall, up to arranging the folding tab above a part of the upper face of the article;

the second folding zone comprising:

third folding means predisposed at least by a flank of a side of the conveyor so as to be able to rotate about a transversal axis of the conveyor and activatable in rotation about the transversal axis, when the conveyor bears the cardboard blank in the second folding zone, so as to abut at least the second lateral closing wall and rotate the second lateral closing wall with respect to the first portion so as to fold the second lateral closing wall with respect to the first portion up to a position facing the second lateral flank of the article so as to cover the second lateral flank of the article and at the same time bring the upper closing wall, hinged to the second lateral closing wall, into a raised position with respect to the upper face of the article placed resting on the first portion of the cardboard blank; and fourth folding means predisposed above the conveyor so as to be able to be lowered or raised with respect to the conveyor so as to be positionable at a height corresponding to the position of the upper closing wall and further predisposed so as to be translatable in a parallel direction to the conveyor so as to abut the upper closing wall and rotate the upper closing wall with respect to the second lateral closing wall so as to fold the upper closing wall with respect to the second lateral closing wall up to bringing the upper closing wall into a position facing and above the upper face of the article so as to be arranged above the two folding tabs folded above the upper face of the article and above the upper face so as to cover the upper face of the article, and thus obtain a cardboard box partially closed with the packaged article internally thereof.

2. The folding station of claim 1, wherein the first folding means comprise a first pusher predisposed by the first flank of the conveyor and movable between a lowered position and a raised position for abutting the third lateral closing wall of the cardboard blank and rotating the third lateral closing wall of the cardboard blank with respect to the first portion so as to bring the third lateral closing wall of the cardboard blank into a position facing the third lateral flank of the article so as to cover the third lateral flank of the article, and a first folding rod having a first curved head portion and a first straight body inclined towards the conveyor, the first folding rod being predisposed so that during the advancement of the cardboard blank by the conveyor through the first folding zone, the first curved-head portion abuts the folding tab hinged to the third lateral closing wall and rotates the folding tab with respect to the third lateral closing wall while the inclined first straight body abuts the folding tab and rotates the folding tab and pushes the folding tab to fold on the upper face of the article, and in that the second folding means in turn comprise a second pusher predisposed by the second flank of the conveyor and mobile between a lowered position and a raised position for abutting the fourth lateral closing wall of the cardboard blank and rotating the fourth lateral closing wall with respect to the first portion so as to bring the fourth lateral closing wall into a position facing the fourth lateral flank of the article so as to cover the fourth lateral flank of the article, and a second folding rod having a second curved head portion and a second straight body inclined towards the conveyor, with the second folding rod predisposed so that during the advancement of the cardboard blank by the conveyor through the first folding zone, the second curved-head portion abuts the folding tab hinged to the fourth lateral closing wall and rotates such folding tab with respect to the fourth lateral closing wall while the inclined second straight body abuts and rotates the folding tab and pushes the folding tab to fold on the upper face of the article.

3. The folding station of claim 2, wherein the first folding rod of the first folding means and the second folding rod of the second folding means being predisposed so as to be mutually nearably or mutually distanceable to/from one another so as to adjust the reciprocal position thereof on the basis of the actual dimension of the cardboard blank and the actual position of the third lateral closing wall and of the fourth lateral closing wall, and further predisposed so as to be raisable or lowerable with respect to the conveyor so as to adjust the height thereof with respect to the conveyor on the basis of the actual height of the third lateral closing wall and of the fourth lateral closing wall.

4. The folding station of claim 3, further comprising a first frame, predisposed above the conveyor at the first folding zone, a second frame, mounted on the first frame so as to be vertically slidable with respect to the first frame, the first folding rod of the first folding means and the second folding rod of the second folding means being predisposed so as to be borne by the second frame and which are predisposed so as to be translatable with respect to the second frame so as to be translatable with respect thereto according to a transversal direction to the conveyor.

5. The folding station of claim 4, further comprising first horizontal sliding guides predisposed on the second frame transversally to the conveyor and in that the first folding rod of the first folding means and the second folding rod of the second folding means are mounted on and borne by carriages predisposed and coupled slidably on the first horizontal sliding guides.

6. The folding station of claim 5, further comprising first movement means for vertical movement of the second frame with respect to the first frame, predisposed for raising or lowering the second frame with respect to the first frame so as to adjust the height of the first folding rod and the second folding rod with respect to the conveyor and adjust the position thereof to the actual height of the third lateral closing wall and of the fourth lateral closing wall, and second movement means for moving the carriages, along the first horizontal sliding guides of the second frame, predisposed for translating the carriages along the first horizontal sliding guides so as to be able to mutually near or distance them to/from one another so as to be able to near or distance the first folding rod and the second folding rod to/from one another so as to adjust and regulate the reciprocal position and distance thereof on the basis of the actual dimension of the cardboard blank and the effective position of the third and fourth lateral closing walls with respect to the conveyor.

7. The folding station of claim 1, further comprising, in the second folding zone, blocking means which are predisposed so as to block the cardboard blank at the second folding zone and enable activation of the third folding means for folding the second lateral closing wall and activation of the fourth folding means for folding the upper closing wall.

8. The folding station of claim 7, wherein the blocking means comprise a pair of jaws which are arranged bilaterally of the conveyor and which are predisposed to be rotatable each about a parallel axis to the conveyor so as to be rotatable between a splayed configuration and a neared configuration so as to abut the third and the fourth lateral closing walls and block the cardboard blank, the pair of jaws being predisposed to be mutually nearable or distanceable to or from one another so as to adjust the reciprocal distance thereof with respect to the actual dimensions of the cardboard blank and the actual distance between the third and the fourth lateral closing walls.

9. The folding station of claim 1, wherein the third folding means provided in the second folding zone comprise at least a pair of battens arranged bilaterally of the conveyor and activatable in rotation about a transversal rotation axis to the conveyor so as to be activated in rotation from a lowered position, in which they are in a horizontal position at a level at most equal to the level of the conveyor, to a raised position, wherein they are in a vertical position, so as to be able to abut the second lateral closing wall and rotate the second lateral closing wall with respect to the first portion of the cardboard blank on which the article is rested so as to fold the second lateral closing wall with respect to the first portion up to a position facing the second lateral flank of the article so as to cover the second lateral flank of the article and at the same time bring the upper closing wall, hinged to the second lateral closing wall, into a raised position with respect to the upper face of the article placed resting on the first portion of the cardboard blank.

10. The folding station of claim 1, wherein the fourth folding means provided in the second folding zone comprise at least a pair of wheels arranged bilaterally of and above the conveyor and mounted idle about relative horizontal and transversal rotation axes to the conveyor, the wheels of the pair of wheels being predisposed in such a way as to be mutually neared or distanced to/from one another so as to adjust the position thereof with respect to the conveyor on the basis of the actual dimensions of the cardboard blank and the actual dimensions and width of the upper closing wall, and further predisposed so as to be lowerable or raisable with respect to the conveyor so as to be positionable at a height corresponding to the position of the upper closing wall, and in that the wheels of the pair of wheels are predisposed so as to be translatable in a parallel direction to the conveyor so as to abut the upper closing wall and rotate the upper closing wall with respect to the second lateral closing wall so as to fold the upper closing wall with respect to the second lateral closing wall up to bringing the upper closing wall into a position facing and above the upper face of the article so as to be arranged above the two folding tabs folded above the upper face of the article and above the upper face so as to cover the upper face.

11. The folding station of claim 10, further comprising a third frame, predisposed above the conveyor at the second folding zone, a fourth frame, mounted on the third frame so as to be vertically slidable with respect to the third frame, with the wheels of the pair of wheels being predisposed so as to be borne by the fourth frame and predisposed to be translatable with respect to the fourth frame so as to be translatable with respect thereto according to a transversal direction to the conveyor.

12. The folding station of claim 11, further comprising second horizontal sliding guides predisposed on the fourth frame transversally to the conveyor and in that the wheels of the pair of wheels are mounted and borne by relative uprights which are constrained and borne by first carriages predisposed and coupled slidably on the second horizontal sliding guides, and also comprising third horizontal sliding guides predisposed on the uprights parallel to the conveyor and in that the rotation axes of the wheels of the pair of wheels are borne by second carriages mounted slidably on the third horizontal sliding guides.

13. The folding station of claim 12, further comprising third movement means for vertical movement of the fourth frame with respect to the third frame, predisposed to raise or lower the fourth frame with respect to the third frame so as to adjust the height of the wheels of the pair of wheels with respect to the conveyor and adjust the position thereof to the actual height of the upper closing wall, and fourth movement means for moving the first carriages, along the second horizontal sliding guides of the third frame, predisposed for translating the first carriages along the second horizontal sliding guides so as to near or distance them to/from one another so as near or distance the uprights which bear the wheels to/from one another, with the purpose of adjusting and regulating the position of the wheels on the basis of the actual dimension of the cardboard blank and the effective width of the upper closing wall, and fifth movement means for translating the second carriages, along the third horizontal sliding guides predisposed on the uprights parallel to the conveyor so as to translate the wheels parallel to the conveyor and towards the upper closing wall so that the wheels abut the upper closing wall so as to rotate the upper closing wall with respect to the second lateral closing wall so as to fold the upper closing wall with respect to the second lateral closing wall up to bringing the upper closing wall into a position facing and above the upper face of the article so as to be arranged above the two folding tabs folded above the upper face of the article and above the upper face so as to cover the upper face of the article.

14. The folding station of claim 5, further comprising folding maintaining means arranged between the first folding zone and the second folding zone and which are predisposed and configured so as to abut the third lateral closing wall and the fourth lateral closing wall and for maintaining them in the folded position thereof facing the third and fourth lateral flank of the article and so as to abut the two folding tabs folded on the upper face of the article so as to maintain the two folding tabs folded against the upper face during the transfer of the cardboard blank by the conveyor from the first folding zone to the second folding zone up to when the upper closing wall is folded and positioned on the upper face of the article.

15. The folding station of claim 14, wherein the folding maintaining means comprise:

a first horizontal bar arranged by a flank of the first folding rod of the first folding means, externally thereof with respect to the conveyor, and predisposed so as to be borne and constrained to the carriages, slidably coupled on the first horizontal sliding guides of the second frame, so as to be externally in contact with the third lateral closing wall so as to maintain the third lateral closing wall pressed against the third lateral flank of the article during the transfer of the cardboard blank by the conveyor from the first folding zone up to the second folding zone;

a second horizontal bar arranged by a flank of the folding rod of the second folding means externally thereof with respect to the conveyor, and predisposed so as also to be borne and constrained to the carriages so as to be externally in contact with the fourth lateral closing wall in order to maintain the fourth lateral closing wall pressed against the fourth lateral flank of the article during the transfer of the cardboard blank by the conveyor from the first folding zone up to the second folding zone; and a pair of ribs predisposed between the first horizontal bar and the second horizontal and so as to be borne and constrained to the carriages so as to be positioned in a position such as to be able to abut the two folding tabs folded on the upper face of the article and maintain them pressed against this upper face during the transfer of the cardboard blank by the conveyor from the first folding zone up to the second folding zone.

16. The folding station of claim 5, further comprising glue applying means, predisposed between the first folding zone and the second folding zone, and configured so as to apply glue on the folding tab folded with respect to the third lateral closing wall on the upper face of the article, and so as to apply glue on the folding tab folded with respect to the fourth lateral closing wall, on the upper face of the article.

17. The folding station of claim 16, wherein the glue applying means comprise a pair of glue dispensing guns which are predisposed so as to be borne and constrained to the carriages mounted slidably on the first horizontal sliding guides of the second frame so as to be positioned on the folding tabs folded on the upper face of the article so as to be able to dispense and apply glue on the folding tabs during the transfer of the cardboard blank by the conveyor from the first folding zone to the second folding zone.

18. A machine for packing an article internally of a cardboard box obtained from a cardboard sheet, comprising:

a store in which a continuous strip of cardboard is predisposed, folded on itself to form a fanfold;

a sectioning station of a cardboard sheet from the continuous strip of cardboard, which sectioning station is situated downstream of the store and comprising: a conveyor plane, predisposed so as to be able to restingly receive the continuous strip of cardboard which is unwound from the fanfold, conveying means, for advancing the continuous strip of cardboard along the conveyor plane in an advancement direction and for halting the continuous strip of cardboard for enabling cutting thereof, a sectioning group, predisposed above the conveyor plane, for sectioning a cardboard sheet from the continuous strip of cardboard and contemporaneously realizing a transversal score line parallel to the edge cut on the continuous strip of cardboard;

a score line forming station, downstream of the sectioning station, into which the cut cardboard sheet coming from the sectioning station is fed, and advanced in an advancement direction, comprising: first score line forming means predisposed to realize, on the cardboard sheet, two longitudinal score lines parallel to the advancement direction and parallel to the longitudinal edges of the cardboard sheet, distanced from one another by a distance corresponding to a length of the base of the article to be packed, so as to identify, in the cardboard sheet, a central sector and two lateral sectors;

second score line forming means that are predisposed for realizing three transversal score lines parallel to one another, and parallel to the fold line previously realized, and distanced so as to identify, in the central sector, together with a fourth score line, constituted by the score line previously realized in the sectioning station, five portions:

a first portion, between the first transversal score line and the second transversal score line having dimensions corresponding to the base of the article to be packed;

a second portion, between a first transversal edge of the cardboard sheet and the first transversal score line, having dimensions corresponding to a first flank of the article;

a third portion, adjacent to the first portion, between the second transversal score line and the third transversal score line having dimensions corresponding to a second flank of the article, opposite the first flank;

a fourth portion, between the third score line and the fourth transversal fold line, having dimensions corresponding to the upper face of the article; and a fifth portion constituted by a strip of material of the cardboard sheet between the fourth transversal score line and the second transversal edge of the cardboard sheet; and third score line forming means which are predisposed so as to realize, in the portions of the cardboard sheet of the two lateral sectors, at flanks of the first portion, pairs of longitudinal folding lines parallel to the two longitudinal score lines and having a same width extension as the first portion, a transversal cutting station, downstream of the score line forming station, into which the cardboard sheet is fed in an advancement direction with the two longitudinal score lines in the central sector, the four transversal score lines and the pairs of folding lines in the two lateral sectors, comprising cutting means for carrying out four transversal cuts for each of the two lateral sectors of the cardboard sheet, at the four transversal score lines, so as to obtain: at the two ends of the second portion, a first reinforcing flap and a second reinforcing flap;

at the two ends of the first portion, a first lateral enveloping flap, containing the first pair of longitudinal folding lines which identify a first folding tab between the folding line and the first longitudinal score line, a second folding tab between the folding line and the edge of the first enveloping flap, and a central portion between the two longitudinal folding lines, and a second lateral enveloping flap, containing the second pair of longitudinal folding lines which identify a third folding tab, between the folding line and the second longitudinal score line, a fourth folding tab between the folding line and the edge of the second enveloping flap and a central portion between the two longitudinal folding lines;

at the two ends of the third portion, a third reinforcing flap and a fourth reinforcing flap;

at the two ends of the fourth portion, a fifth reinforcing flap and a sixth reinforcing flap;

and forming, between the fourth transversal score line and the second transversal edge, a tab for closing the cardboard box, so as to provide, at the outlet of the transversal cutting station, a cardboard blank for packing an article;

a first folding station, downstream of the transversal cutting station, into which the cardboard blank is fed in an advancement direction and in which the cardboard blank is halted and comprising: a first folding bar, arranged at a first side of the cardboard blank and rotatable about a rotation axis that is parallel to the advancement direction of the cardboard blank so as to abut the first reinforcing flap, the first folding tab of the first lateral enveloping flap, the third reinforcing flap and the fifth reinforcing flap present in the first lateral sector of the cardboard blank, and to rotate them about the first longitudinal score line so as to fold and arrange them respectively:

the first reinforcing flap above the second portion of the central sector;

the first folding tab above a part of the first portion of the central sector;

the third reinforcing flap above the third portion of the central sector and the fifth reinforcing flap above the fourth portion of the central sector; and a second folding bar arranged by a flank of the second side of the cardboard blank and which is rotatable about a rotation axis parallel to the advancement direction of the cardboard blank so as to abut the second reinforcing flap, the third folding tab of the second lateral enveloping flap, the fourth reinforcing flap and the sixth reinforcing flap present in the second lateral sector of the cardboard blank, in order to rotate them about the second longitudinal fold line so as to fold and arrange them respectively: the second reinforcing flap above the second portion of the central sector;

the third folding tab above a part of the first portion of the central sector;

the fourth reinforcing flap above the third portion of the central sector and the sixth reinforcing flap above the fourth portion of the central sector, so that: the second portion with the first reinforcing flap and second reinforcing flap folded thereon form a first lateral closing wall;

the third portion with the third and fourth reinforcing flaps folded thereon form a second lateral closing wall;

the first folding tab of the first lateral enveloping flap folded above a part of the first portion of the central sector forms a reinforcing edge while the central part of the first lateral enveloping flap in the raised position defines a third lateral closing wall, and the third folding tab of the second lateral enveloping flap folded above a part of the first portion of the central sector forms a reinforcing edge, while the central part of the second lateral enveloping flap in the raised position defines a fourth lateral closing wall, a feeding station of an article to be packed, to which the cardboard blank coming from the first folding station is fed and wherein an article to be packed is deposited and rested by the base wall thereof on the first portion of the cardboard blank, with a first flank facing towards the first lateral closing wall, a second flank, opposite the first, facing towards the second lateral closing wall, a third flank, transversal to the first two, facing towards the third lateral closing wall, and a fourth flank, opposite the third, facing towards the fourth lateral closing wall;

a second folding station at which the cardboard blank with the article rested thereon, on the first portion thereof, is fed and advanced in an advancement direction which is realized according to the folding station of claim 1, and comprising: the first folding means for rotating the third lateral closing wall and folding the third lateral closing wall up to when it goes to cover the third flank of the article, and for rotating the second folding tab, with respect to the folding line which separates it from the third lateral closing wall, and folding the second folding tab up to superposing it on a part of the upper face of the article;

the second folding means for rotating the fourth lateral closing wall, and folding the fourth lateral closing wall up to when it goes to cover the fourth flank of the article, and for rotating the fourth folding tab, with respect to the folding line which separates it from the fourth lateral closing wall, so as to fold the fourth folding tab up to superposing it on a part of the upper face of the article;

glue applying means predisposed for applying glue on the second and fourth folding tab folded onto the upper face of the article;

the blocking means, for blocking and halting the cardboard blank once the means for applying glue have applied the glue;

the third folding means for rotating the second lateral closing wall, so as to fold it with respect to the first portion on which the article is rested up to when it goes to cover the second flank of the article, and the fourth folding means for rotating, in succession, the upper closing wall, and for folding it with respect to the second lateral closing wall up to when it goes to cover the upper face of the article, and therefore provide in outlet from the second folding station a cardboard box partially closed with the packed article internally thereof;

a final closing station, situated downstream of the second folding station, to which the partially-closed cardboard box is fed, and comprising: stop means activatable for halting the cardboard box;

fifth folding means predisposed for being activated once the box has been halted for rotating the first lateral closing wall, with respect to the first transversal score line, so as to fold it with respect to the first portion on which the article is rested so that it goes to cover the first flank of the article;

a glue applying organ, functionally associated to the fifth folding means, and predisposed for applying glue on a part of the first lateral closing wall while it is folded by the fifth folding means against the first flank of the article, and sixth folding means activatable for rotating the closing tab with respect to the fourth transversal score line, and folding the closing tab with respect to the upper wall against the upper part of the first lateral closing wall on which the glue had been applied, in order to make it adhere thereto and complete the closing of the cardboard box with the article packed internally thereof, in order to provide at the outlet of the final closing station a cardboard box completely closed with the packed article internal thereof.

* * * * *